US007084839B2

(12) United States Patent
Onozawa et al.

(10) Patent No.: US 7,084,839 B2
(45) Date of Patent: Aug. 1, 2006

(54) PRE-DRIVE CIRCUIT, CAPACITIVE LOAD DRIVE CIRCUIT AND PLASMA DISPLAY APPARATUS

(75) Inventors: Makoto Onozawa, Kawasaki (JP); Yoshinori Okada, Kawasaki (JP); Hideaki Ohki, Yokohama (JP); Masatoshi Hira, Kawasaki (JP); Haruo Koizumi, Kawasaki (JP)

(73) Assignee: Fujitsu Hitachi Plasma Display Limited, Kawasaki (JP)

( * ) Notice: Subject to any disclaimer, the term of this patent is extended or adjusted under 35 U.S.C. 154(b) by 47 days.

(21) Appl. No.: 10/776,286

(22) Filed: Feb. 12, 2004

(65) Prior Publication Data

US 2004/0160437 A1 Aug. 19, 2004

(30) Foreign Application Priority Data

Feb. 18, 2003 (JP) ..... 2003-039709
Dec. 24, 2003 (JP) ..... 2003-427980

(51) Int. Cl.
*G09G 3/20* (2006.01)
*G09G 3/28* (2006.01)
*G09G 3/10* (2006.01)

(52) U.S. Cl. ..... 345/55; 345/60; 345/204; 315/169.1; 315/169.2; 315/169.3; 315/169.4

(58) Field of Classification Search .. 315/169.1–169.4; 345/55, 60, 204; 327/111, 333
See application file for complete search history.

(56) References Cited

U.S. PATENT DOCUMENTS 5,502,412 A * 3/1996 Choi et al. ..... 327/333
5,543,740 A 8/1996 Wong ..... 327/108
6,426,594 B1 * 7/2002 Ito ..... 315/169.1
6,885,225 B1 * 4/2005 Ohmichi et al. ..... 327/112
2002/0175883 A1 * 11/2002 Onozawa et al. ..... 345/67

FOREIGN PATENT DOCUMENTS

| | | | |
|---|---|---|---|
| EP | 1 139 323 | A2 * | 10/2001 |
| JP | 8-335863 | | 12/1996 |
| JP | 2001-282181 | | 10/2001 |
| JP | 2002-351388 | | 12/2002 |
| TW | 299959 | | 3/1997 |
| TW | 453024 | | 9/2001 |
| WO | WO 02/095914 | | 11/2002 |
| WO | WO 02/095914 | A2 * | 11/2002 |

OTHER PUBLICATIONS

Republic of China Office Action dated Jul. 20, 2005.

* cited by examiner

*Primary Examiner*—Don Wong

*Assistant Examiner*—Leith Al-Nazer

(74) *Attorney, Agent, or Firm*—Staas & Halsey LLP

(57) ABSTRACT

A pre-drive circuit having low deviation of timing of a high level and a low level output voltages is disclosed. A plurality of drive systems are comprised, each having an input amplifier circuits for amplifying input voltages input to input voltage terminals, high level shift circuits for shifting signal levels output from the input amplifier circuits, and output amplifier circuits for amplifying shift signals output from the high level shift circuits, and each drive system has the same constitution.

3 Claims, 26 Drawing Sheets

PRE-DRIVE CIRCUIT, CAPACITIVE LOAD DRIVE CIRCUIT AND PLASMA DISPLAY APPARATUS

BACKGROUND OF THE INVENTION

The present invention relates to a pre-drive circuit and a capacitive load drive circuit and to a plasma display apparatus using the same. More particularly, the present invention relates to an improvement in the timing of a drive signal by which a sustain discharge is caused.

The plasma display apparatus has been put to practical use as a flat display and is a thin display with high luminance. FIG. 1 is a diagram showing the general constitution of a conventional three-electrode AC-driven plasma display apparatus. As shown schematically, the plasma display apparatus comprises a plasma display panel (PDP) 1 consisting of two substrates between which a discharge gas is enclosed, each substrate having a plurality of X electrodes (X1, X2, X3, . . . , Xn) and a plurality of Y electrodes (Y1, Y2, Y3, . . . , Yn) arranged adjacently by turns, a plurality of address electrodes (A1, A2, A3, . . . , Am) arranged in the direction perpendicular to the X and Y electrodes and phosphors arranged at the crossings, an address driver 2 which applies an address pulse or the like to the address electrode, an X common driver 3 which applies a sustain discharge pulse or the like to the X electrodes, a scan driver 4 which applies a scan pulse or the like sequentially to the Y electrodes, a Y common driver 5 which supplies a sustain discharge pulse or the like, to be applied to the Y electrodes, to the scan driver 4, and a control circuit 6 which controls each part, wherein the control circuit 6 has a display data control section 7 which further includes a frame memory and a drive control circuit 8 including a scan driver control section 9 and a common driver control section 10. The X common driver 3 and the Y common driver 5 respectively include sustain circuits which output sustain pulses, and each sustain circuit has a sustain output element. As the plasma display apparatus is widely known, a detailed description about the whole apparatus is not given here but only the X common driver 3 and the Y common driver 5 relating to the present invention are described here. The X common driver, the scan driver and the Y common driver of the plasma display apparatus have been disclosed in, for example, Japanese Unexamined Patent Publication (Kokai) No. 2001-282181 and Japanese Unexamined Patent Publication (Kokai) No. 2002-351388. Japanese Unexamined Patent Publication (Kokai) No. 8-335863 has disclosed a power transistor drive circuit used in such a driver and an IC formed into a single chip by integrating the drive circuit.

FIG. 2 is a block diagram showing the general constitution of the power transistor drive circuit disclosed in Japanese Unexamined Patent Publication (Kokai) No. 8-335863, and the whole is provided in an IC 11 as shown by the dotted line. In the plasma display apparatus, the power transistor drive IC in FIG. 2 is used as a pre-drive circuit for driving a sustain output element. In the power transistor drive IC 11 shown in FIG. 2, a high level input voltage HIN is amplified in an input amplifier circuit 21, converted into a voltage referred to a high level reference voltage Vr in a high level shift circuit 22, and output as a high level output voltage HO via an output amplifier circuit 23. On the other hand, a low level input voltage LIN is amplified in an input amplifier circuit 24 and output as a low level output voltage LO after input into an output amplifier circuit 26 via a delay circuit 25 and amplified therein. Reference numbers 12 and 13 respectively denote input terminals of the high level input voltage HIN and the low level input voltage LIN, reference number 16 and 19 respectively denote output terminals of the high level output voltage HO and the low level output voltage LO, reference number 15 denotes a supply terminal of a high level supply voltage Vc, reference number 17 denotes a supply terminal of the high level reference voltage Vr, reference number 18 denotes a supply terminal of a low level supply voltage Vd, and reference number 20 denotes a ground terminal.

In the power transistor drive IC shown in FIG. 2, the delay circuit 25 serves to adjust the difference tdLH (HO) in the rise times between the high level input voltage HIN and the high level output voltage HO and the difference tdLH(LO) in the rise times between the low level input voltage LIN and the low level output voltage LO so that they are equal. Moreover, the delay circuit 25 also serves to adjust the difference tdHL(HO) in the fall times between the high level input voltage HIN and the high level output voltage HO and the difference tdHL(LO) in the fall times between the low level input voltage LIN and the low level output voltage LO so that they are equal. However, it is impossible for the delay circuit 25 to make tdLH(HO) and tdLH(LO) coincide with each other perfectly, and it is inevitable that a certain difference occurs. Similarly, it is also impossible to make tdHL(HO) and tdHL(LO) coincide with each other perfectly, and it is inevitable that a certain difference occurs.

When the power transistor drive IC shown in FIG. 2 is used as a pre-drive circuit in a plasma display apparatus, sustain output elements such as a power MOSFET and an IGBT (Insulated Gate Bipolar Transistor) are connected to the output terminals 16 and 19. In a plasma display apparatus (PDP apparatus), a sustain pulse is generated, by turning on/off a sustain output element, and is supplied to the X electrode and the Y electrode of a plasma display panel (PDP).

FIG. 3 shows an example of a sustain circuit in a PDP apparatus, where the power transistor drive IC in FIG. 2 is used as a pre-drive circuit 11A and a pre-drive circuit 11B of the sustain output elements. In FIG. 3, CU and CD denote the sustain output elements, and by turning on/off these output elements, a sustain pulse is supplied to the PDP corresponding to a capacitive load. In FIG. 3, an input signal CUI is input as a high level input voltage of the pre-drive circuit 11A and supplied to the output element CU as a high level output voltage. On the other hand, an input signal CDI is input as a low level input voltage of the pre-drive circuit 11A and supplied to the output element CD as a low level output voltage.

When the output element CU is turned on, a supply voltage Vs is supplied to the PDP via a diode D1 and the output element CU (at this time the output element CD is off). When the output element CD is turned on, a ground (GND) voltage is supplied to the PDP via the output element CD (at this time the output element CU is off). On the other hand, the supply voltage of the pre-drive circuit 11A for driving the output element CU (high level supply voltage maintained across a capacitor C1) is charged across the capacitor C1 from a power supply Ve via a diode D2. The supply voltage of the pre-drive circuit 11A for driving the output element CD (low level supply voltage maintained across a capacitor C2) is charged directly across the capacitor C2 from the power supply Ve. In the circuit shown in FIG. 3, a sustain pulse is supplied to the PDP by turning on/off the output elements CU and CD alternately.

LU and LD in FIG. 3 are power recovery output elements and the power supplied to the PDP through the CU and CD is reduced by turning on/off the LU and the LD. In FIG. 3, an output signal LUI is input as a high level input voltage of the pre-drive circuit and supplied to the output element LU as a high level output voltage. An input signal LDI is input as a low level input voltage of the pre-drive circuit and supplied to the output element LD as a low level output voltage.

When the output element LU is turned on, a middle point voltage Vp of capacitors C5 and C6 connected in series between the supply voltage Vs and the GND is supplied to the PDP via the output element LU, a diode D4 and a coil L1 (at this time, the output element LD is off). On the other hand, when the output element LD is turned on, the above-mentioned middle point voltage Vp is supplied to the PDP via a coil 2, a diode D5 and the output element LD (at this time, the output element LU is off). The supply voltage (high level supply voltage maintained across a capacitor C3) of the pre-drive circuit for driving the output element LU is charged across the capacitor C3 from the power supply Ve via a diode D3. On the other hand, the supply voltage (low level supply voltage maintained across a capacitor C4) of the pre-drive circuit for driving the output element LD is charged across the capacitor C4 directly from the power supply Ve. In the circuit shown in FIG. 3, the output element LU is turned on immediately before the sustain output element CU is turned on, and the output element LD is turned on immediately before the output element CD is turned on and, thus, the power loss caused by the CU and the CD is reduced.

In the circuit shown in FIG. 3, a switch SW1 is turned on during the reset period of the plasma display apparatus and serves to supply a reset voltage Vw to the PDP via the output element CU.

In the pre-drive circuit using the power transistor drive IC shown in FIG. 2, the delay circuit 25 adjusts the difference tdLH(HO) in the rise times between the high level input voltage HIN and the high level output voltage HO and the difference tdLH(LO) in the rise times between the low level input voltage LIN and the low level output voltage LO so that they are equal. However, the high level shift circuit in the pre-drive circuit is not same as the delay circuit which delays time by the amount corresponding to the delay time in the circuit, and it is impossible to perfectly make the two circuits coincide with each other with respect to the delay characteristics including variations in elements and the temperature characteristic. As a result, it is inevitable that a difference occurs between tdLH(HO) and tdLH(LO).

When the pre-drive circuit, in which there is a difference between tdLH(HO) and tdLH(LO), is applied to the sustain circuit in the plasma display apparatus shown in FIG. 3, there is the possibility that the on/off timing of the output elements CU and CD deviates from the designed value. If the deviation of the timing occurs, there is the possibility that the output elements are turned on at the same time, therefore, a through current flows from CU to CD, and an over-current may destroy the elements.

Similarly, there is the possibility that the timing with which the power recovery output elements LU and LD are turned on deviates from the designed value. Because of the deviation of the timing, there is the possibility that the power recovery current at rise (current flowing through L1) and the power recovery current at fall (current flowing through L2) become unbalanced, therefore, the value of the middle point voltage Vp of the capacitors C5 and C6 deviates from the middle voltage and the power recovery operation is not carried out normally, and the power consumption may increase.

Further, there is a constitution in which a withstand voltage of an output element is reduced by using sustain pulses having the same absolute value but opposite polarities. However, control signals are signals which are referred to ground. Therefore, when a drive signal of a negative voltage is output from the above-mentioned pre-drive circuit, it is necessary that the low level reference voltage of the pre-drive circuit is changed to the negative sustain voltage and a level shift circuit is provided to convert an input voltage signal to a signal referred to the negative sustain voltage. As the level shift circuit and the above pre-drive circuit are different circuits, the above-mentioned same problem occurs.

In recent years, the plasma display apparatus is required to have an increased number of sustain pulses in a frame by decreasing a period of the sustain pulse (sustain period) in order to increase brightness. However, if the sustain period is reduced, the above-mentioned problems become more important.

SUMMARY OF THE INVENTION

The object of the present invention is to realize a pre-drive circuit in which the deviation of the timing of the high level output voltage and the low level output voltage is reduced and to prevent the destruction of the elements and the increase in power consumption in a capacitive load drive circuit and a plasma display apparatus using the same.

To realize the above-mentioned object, a pre-drive circuit according to the present invention comprises a plurality of drive systems with the same constitution having an input amplifier circuit, a high level shift circuit and an output amplifier circuit.

The delay circuit 25 shown in FIG. 2 has a circuit constitution simpler than that of the high level shift circuit 22 and the circuit size can be reduced. In the low level voltage drive system, it is not necessary to shift the amplified input power signal to a high level one, therefore, in the conventional pre-drive circuit (power transistor drive IC), a delay circuit was used to reduce the circuit size. However, the present inventors have found that this constitution brings about the above-mentioned problem.

If the pre-drive circuit of the present invention is used, no deviation of timing is caused because a plurality of drive systems having the same constitution are provided and the high level voltage drive system and the low level voltage drive system can be made to have the same constitution by using the high level shift circuit instead of the delay circuit. Therefore, if an IC using this pre-drive circuit is used, it is possible to precisely set the rise timing and the fall timing of the gate pulse for driving the output elements CU and CD to a desired situation. Because of this, the destruction due to the over-current caused by the simultaneous turning on of the CU and CD can be avoided.

If the pre-drive circuit of the present invention is used, it is possible to precisely set the rise timing and the fall timing of the gate pulse for driving the output elements LU and LD to a desired situation. Therefore, it is possible to reduce the change in the middle voltage Vp of the capacitors C5 and C6 owing to the unbalance between the power recovery (current flowing through L1) at the rise of the sustain pulse and the power recovery (current flowing through L2) at the fall of the sustain pulse. Because of this, the increase in power consumption caused by the abnormal power recovery operation can be prevented.

The level shift circuit shifts the input voltage in accordance with the reference supply voltage to be supplied thereto. Therefore, the level shift circuit making up the low level voltage drive system is supplied with a corresponding reference supply voltage. In the examples in FIG. 2 and FIG. 3, the reference supply voltage of the low level voltage drive system is the ground (GND) level but in a constitution to be described later, in which the high level output voltage and the low level output voltage have the same absolute value but opposite polarities, it is also possible to supply a positive reference supply voltage to one of the drive systems, and a negative reference supply voltage to the other drive system, by using the pre-drive circuit of the present invention.

It is desirable to form the plurality of drive systems on the same semiconductor chip, that is, to integrate them into an IC. Due to this, the similarity of the circuit characteristics of the two drive systems can be enhanced.

It is desirable to provide a supply voltage terminal for supplying the drive power supply of the input amplifier circuit of the plurality of drive systems separately from a supply voltage terminal for supplying the drive power supply of the output amplifier circuit of the plurality of drive systems.

It is also possible to provide a waveform processing circuit such as a Schmitt trigger circuit between each input voltage terminal and input amplifier circuit of the plurality of drive systems. In this case, it is necessary to supply another supply voltage to the waveform processing circuit, therefore, a power supply terminal for the waveform processing circuit is provided or a constant voltage circuit is provided which generates a supply voltage for the waveform processing circuit by converting the voltage supplied to the supply voltage terminal for the input amplifier circuit.

It is desirable that a number of drive systems provided in the pre-drive circuit is two or four.

When a capacitive load drive circuit such as a sustain circuit of a plasma display apparatus is configured by using a pre-drive circuit (IC) having two drive systems, a pre-drive circuit having two drive systems, a first switch element (CU) connected to the output of the output amplifier circuit of one of the drive systems, and a second switch element (CD) connected to the output of the output amplifier circuit of the other drive system are provided, and a high level voltage is supplied to the capacitive load via the first switch element and a low level voltage is supplied to the capacitive load via the second switch element. When a power recovery circuit is provided in the capacitive load drive circuit, a second pre-drive circuit having two drive systems is further provided, and a third switch element (LU) connected to the output of the output amplifier circuit of one of the drive systems of the second pre-drive circuit and a fourth switch element (LD) connected to the output of the output amplifier circuit of the other drive system are provided, and a high level voltage is supplied to the capacitive load via the third switch element and a first coil and a low level voltage is supplied to the capacitive load via the fourth switch element and a second coil.

When a capacitive load drive circuit having a power recovery circuit is configured by using a pre-drive circuit having four drive systems, the first to fourth switch elements are each connected to the outputs of the four output amplifier circuits.

In order to adjust the timing more precisely, it is desirable to provide a delay time adjusting circuit for adjusting the input and output time of a signal at the previous or subsequent stage of the pre-drive circuit. A delay time adjusting circuit can be realized, for example, by the combination of a variable resistor which selects a resistance value to be used from among a plurality of resistance values and a capacitor. When the number of selectable resistance values is the same, the smaller the range of the selectable resistance values, the more precisely the resistance value can be adjusted. According to the present invention, a more precise adjustment can be attained because the deviation range of timing can be reduced compared to conventional cases.

It is also possible to supply a voltage other than the middle voltage between the high level voltage and the low level voltage to a terminal of the third switch which is not connected to the capacitive load.

The high level voltage and the low level voltage can be set arbitrarily and, for example, the high level voltage is set to the supply voltage and the low level voltage is set to the ground voltage, or the high level voltage is set to a positive voltage and the low level voltage is set to a negative voltage the absolute value of which is the same as that of the high level voltage.

When the low level voltage is a negative voltage, an input level shift circuit which converts a level of an input signal referred to the ground voltage into one referred to the low level voltage is provided in the previous stage of the plurality of input voltage terminals of the pre-drive circuit.

Further, when the above input level shift circuit or the waveform processing circuit is provided, these circuits are desired to be provided in the pre-drive circuit. By this, a difference of timing occurred when these circuits are separately provided from the pre-drive circuit can be reduced.

Further, when the input level shift circuit and the waveform processing circuit are provided in the pre-drive circuit, the above-mentioned constitutions are desired to be applied. For example, source voltage terminals of respective circuits should be separately provided, and the pre-drive circuit including the input level shift circuit and the waveform processing circuit should be formed in a package and, particularly, on a same semiconductor chip. In other words, they are desired to be formed in an integrated circuit.

Further, it is desired that noise is removed by providing an integrating circuit in the waveform processing circuit.

Further, a simultaneously ON avoiding circuit is desired to be provided to maintain one of outputs of two drive systems, outputting a pair of drive signals for paired drive elements, to be inactive when the other is active.

According to the present invention, it is possible to reduce the difference in the input and output delay times which occur between the high level side and the low level side of the pre-drive circuit. Moreover, by applying a capacitive load drive circuit which uses the pre-drive circuit to a plasma display apparatus, it is possible to prevent the destruction of elements and an increase in power consumption caused by the difference in the input and output delay times.

BRIEF DESCRIPTION OF THE DRAWINGS

The features and advantages of the invention will be more clearly understood from the following description taken in conjunction with the accompanying drawings, wherein.

DESCRIPTION OF THE PREFERRED EMBODIMENTS

Figure 4:
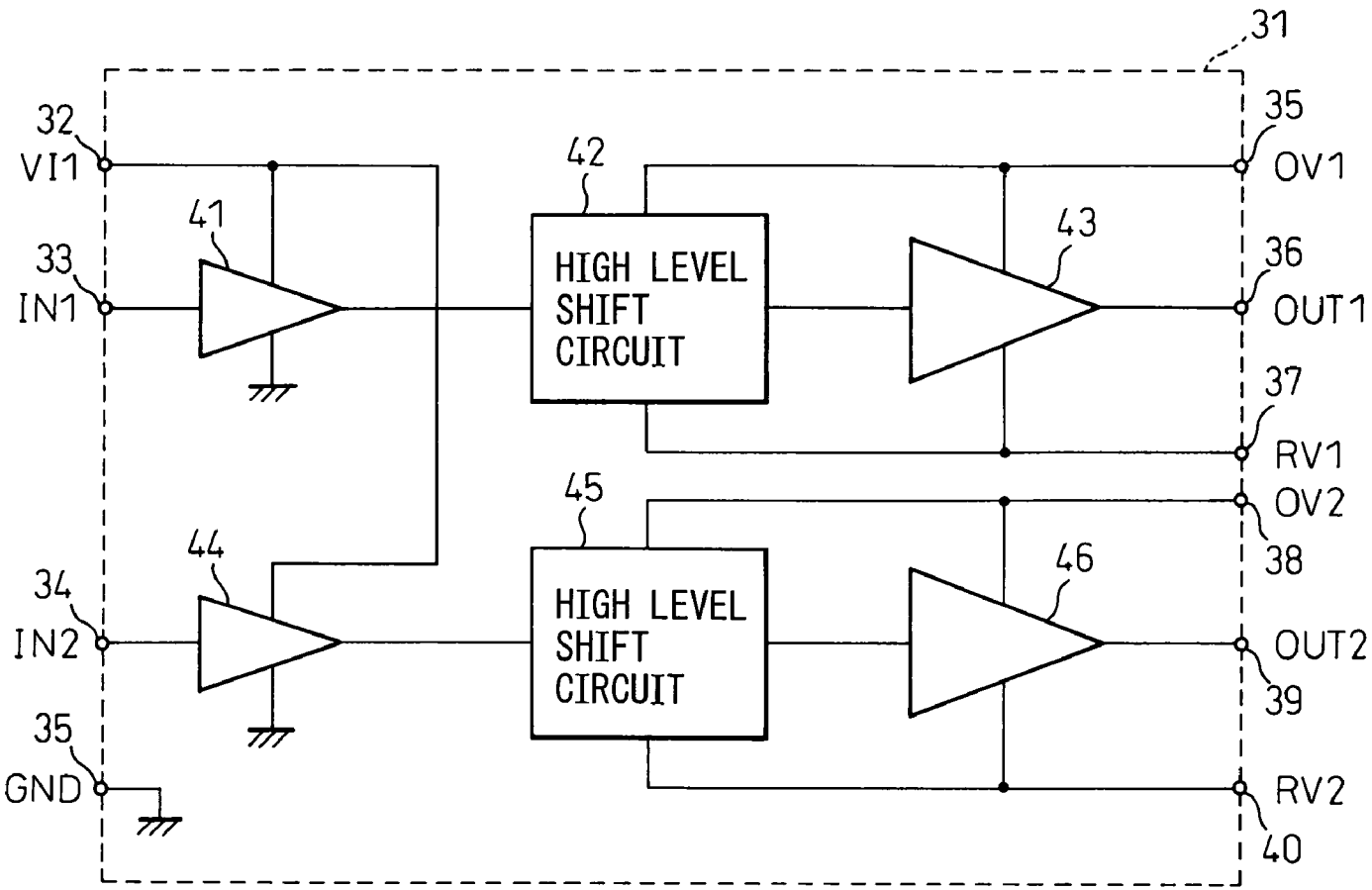
FIG. 4 is a diagram showing the constitution of a pre-drive circuit in a first embodiment of the present invention.

FIG. 4 is a diagram showing the constitution of a pre-drive circuit in a first embodiment of the present invention. As shown in FIG. 4, a first drive system includes a first input amplifier circuit 41, a first high level shift circuit 42 and a first output amplifier circuit 43, and a second drive system includes a second input amplifier circuit 44, a second high level shift circuit 45 and a second output amplifier circuit 46. The first and second input amplifier circuits 41 and 44, the first and second high level shift circuits 42 and 45 and the first and second output amplifier circuits 43 and 46 are, respectively, the same circuits. As a result, it is possible to make a difference (tdLH1−tdLH2) between a difference tdLH1 in the rise times between a first input voltage IN1 and a first output voltage OUT1, and a difference tdLH2 in the rise times between a second input voltage IN2 and a second output voltage OUT2 less than that of the conventional power transistor drive IC (pre-drive circuit) shown in FIG. 2. Similarly, it is possible to make a difference (tdHL1−tdHL2) between a difference tdHL1 in the fall times between the IN1 and OUT1, and a difference tdHL2 in the fall times between the IN2 and OUT2 less than that of the conventional pre-drive circuit shown in FIG. 2.

By forming the pre-drive circuit within the package shown by the dotted line, particularly within the IC (integrated circuit) 11, it is possible to reduce the variations in the elements in the circuit and make the above-mentioned differences (tdLH1−tdLH2) and (tdHL1−tdHL2) smaller.

Figure 5A:
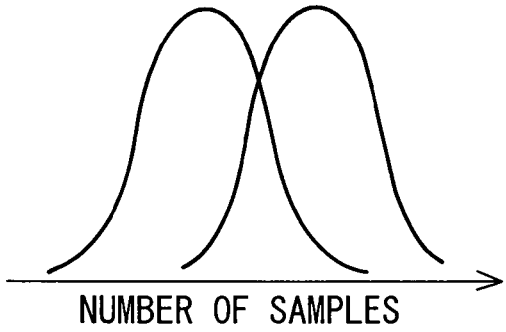
FIGS. 5A to 5C are diagrams illustrating the input and output delay time and the distribution of the differences according to the conventional case and the present invention.
Figure 5B:
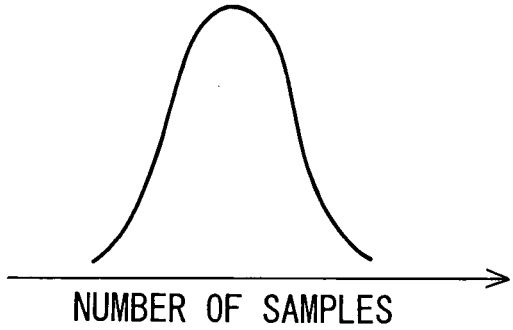
Figure 5C:
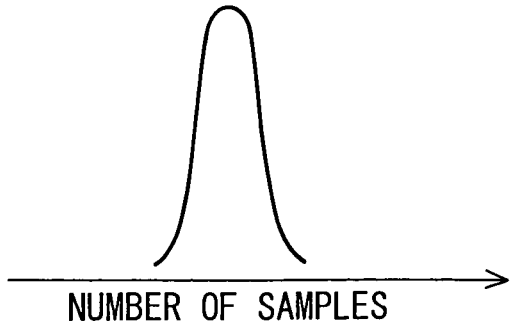

FIGS. 5A to 5C are diagrams showing the effect of the pre-drive circuit of the present invention, that is, a diagram illustrating the reduction in deviation of timing. FIG. 5A and FIG. 5B show distribution examples of the input and output delay time (difference in the rise times between the input voltage and the output voltage) obtained by sampling the manufactured circuits. As shown in FIG. 5A, conventionally, a high level voltage drive system has a high level shift circuit and a low level voltage drive system has a delay circuit, that is, the two circuits have different constitutions, therefore, the input and output delay times vary around different values as centers. Therefore, the differences in input and output delay times between the two drive systems vary around the difference between two centers and the absolute values become larger. In contrast, according to the present invention, a high level voltage drive system and a low level voltage drive system have the same constitution, therefore, the differences vary around the same value as a center as shown in FIG. 5B, that is, the differences in input and output delay times between the two drive systems vary around zero, and as a result, the absolute values become smaller than conventional ones.

Moreover, when two drive systems of a pre-drive circuit are formed within the same package or in the same IC, the input and output delay times of the two drive systems having the same constitution are thought to show a similar tendency and, therefore, the difference in input and output delay times between the two drive systems becomes further smaller as shown in FIG. 5C. According to the present invention, as described above, it is possible to considerably reduce the difference in input and output delay times between the two drive systems.

Figure 1:
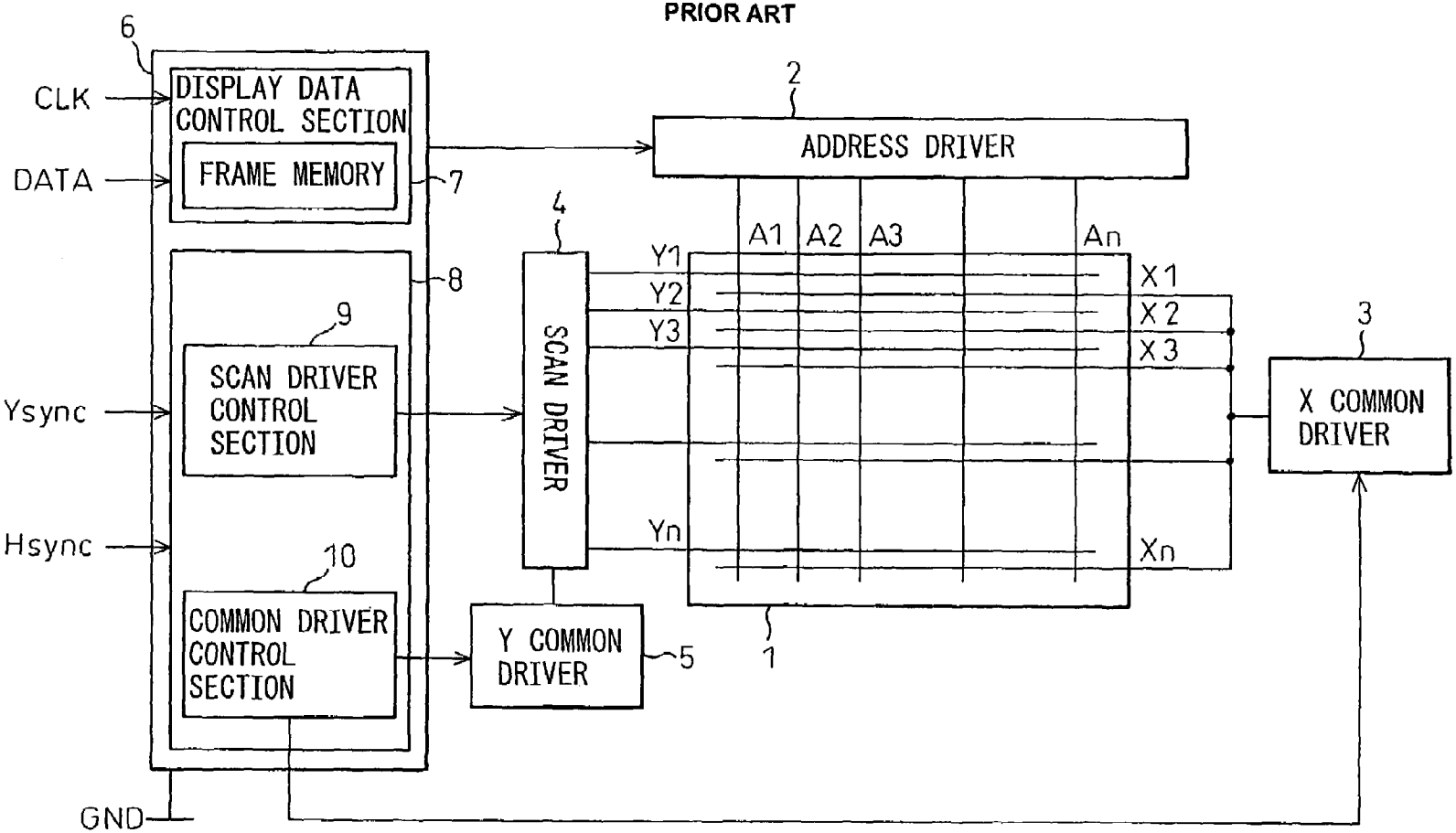
FIG.1 PRIOR ART
FIG. 1 is a diagram showing the general constitution of a plasma display apparatus.
Figure 2:
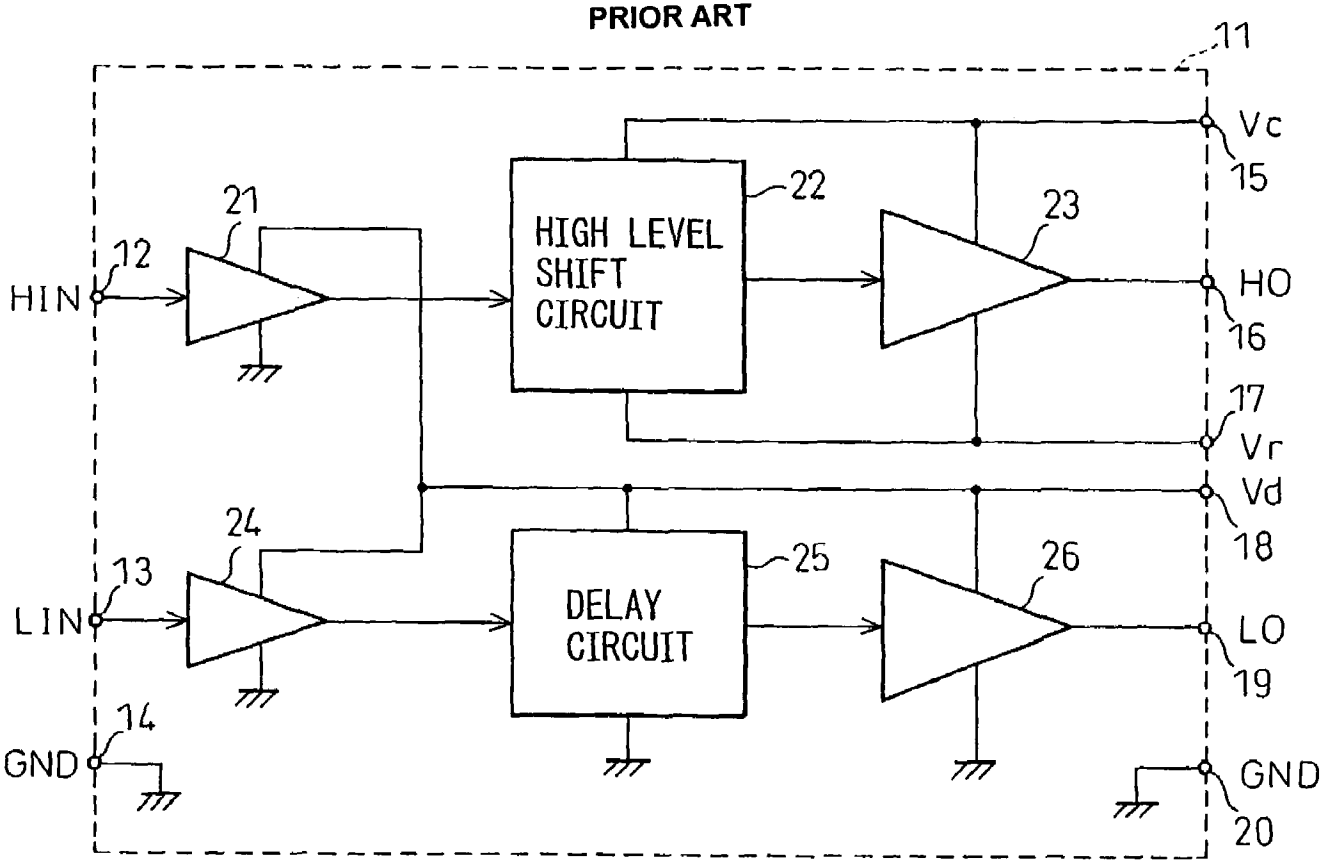
FIG.2 PRIOR ART
FIG. 2 is a diagram showing a conventional pre-drive circuit (power transistor drive IC)

In the conventional pre-drive circuit shown in FIG. 2, the low level supply voltage is used as the supply voltage of the first and second input amplifier circuits 21 and 24. As a result, for example, even when only a high level voltage drive system, which outputs the output voltage HO for the input voltage HIN, is used, it is necessary to input a low level supply voltage. In contrast, in the pre-drive circuit in the first embodiment shown in FIG. 4, the supply voltage of the input amplifier circuits 41 and 42 is supplied by providing an independent input amplifier circuit supply voltage input terminal VI1 32. As a result, when only a high level voltage drive system is used, for example, it is not necessary to supply a supply voltage for the second output amplifier circuit 46 and the input section and the output section can be designed independently.

Figure 6:
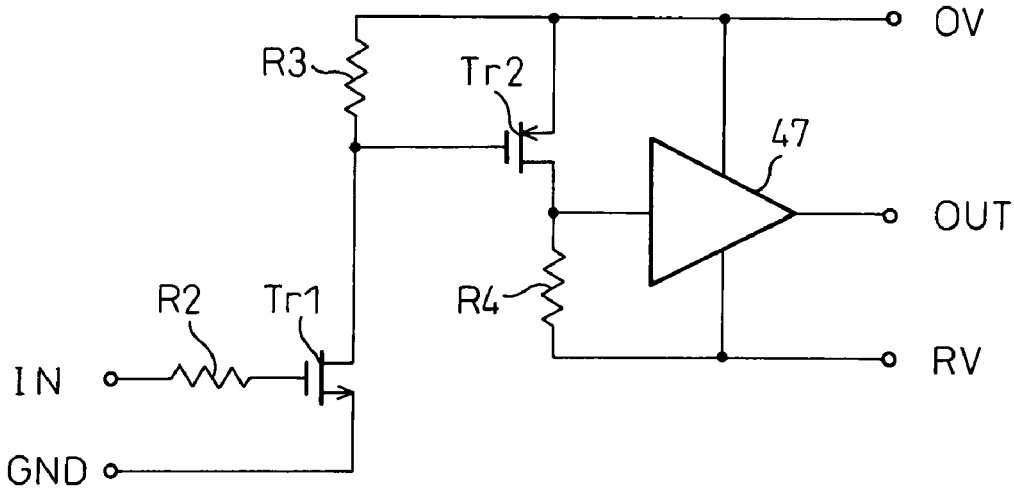
FIG. 6 is a diagram showing a specific constitution of a high level shift circuit of the pre-drive circuit in the first embodiment.

FIG. 6 is a diagram showing a specific constitution of the input amplifier circuit and the high level shift circuit in the pre-drive circuit in the first embodiment. An input voltage IN is applied to the gate of a transistor Tr1 via a resistor R2. The drain of the transistor Tr1 is connected to a high level supply voltage OV and generates a voltage signal in accordance with an input voltage at the connection point of the transistor Tr1 and the resistor R3. This voltage signal is applied to the gate of a transistor Tr2 connected to a high level reference power supply RV via the high level supply voltage OV and a resistor R4. Because of this, a voltage which varies, with reference to the high level reference power supply RV, is generated at the connection point of the transistor Tr2 and the resistor R4 and this voltage is supplied to an output amplifier circuit 47. The high level shift circuit is widely used and any type can be used and, for example, the high level shift circuit disclosed in Japanese Unexamined Patent Publication (Kokai) No. 8-335863, described above, can be used.

Figure 7:
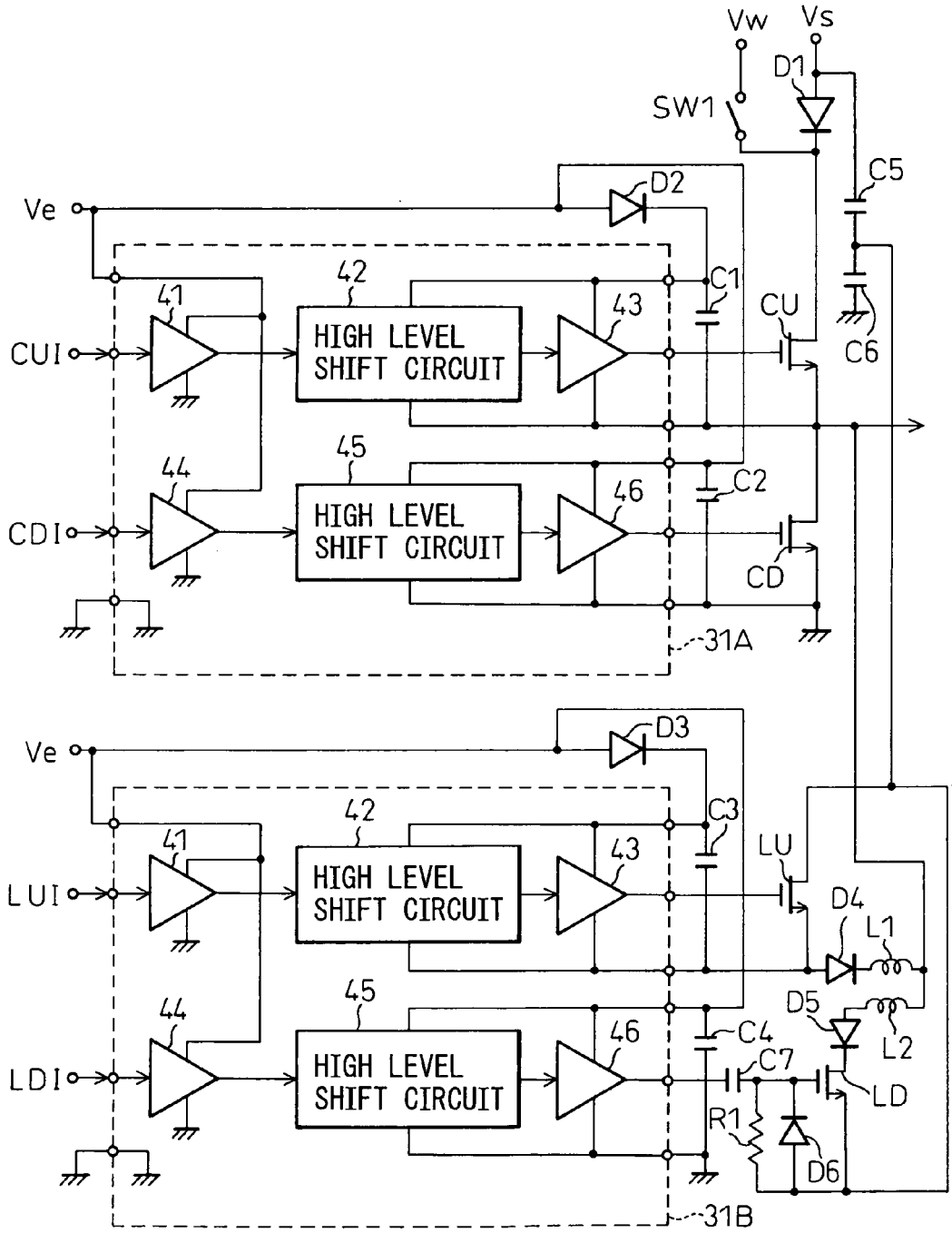
FIG. 7 is a diagram showing the constitution of a sustain circuit in a second embodiment of the present invention.

FIG. 7 shows the constitution of a sustain circuit of a plasma display apparatus in a second embodiment of the present invention. As shown schematically, the sustain circuit in the second embodiment has a constitution similar to that of the conventional sustain circuit shown in FIG. 3, but differs in that the pre-drive circuit for driving the output elements CU, CD, LU and LD is realized by using the pre-drive circuit in the first embodiment.

As shown in FIG. 7, by using the pre-drive circuit in FIG. 4 as the pre-drive circuit of the sustain circuit, it is possible to more precisely set the rise time and the fall time of the gate pulse to be supplied to the output elements CU and CD. As a result, it is possible to reduce the possibility that the output elements CU and CD are destroyed by a through current when they are turned on simultaneously. Moreover, it is possible to more precisely set the rise time and the fall time of the gate pulse to be supplied to the output elements LU and LD. As a result, it is possible to precisely set the timing with which the output elements LU and LD are turned on and to properly set the values of the power recovery current flowing through the coil L1 and the power recovery current flowing through the coil L2. Therefore, it is possible to prevent the increase in power consumption caused by the deviation of timing with which the output elements LU and LD are turned on.

Figure 8:
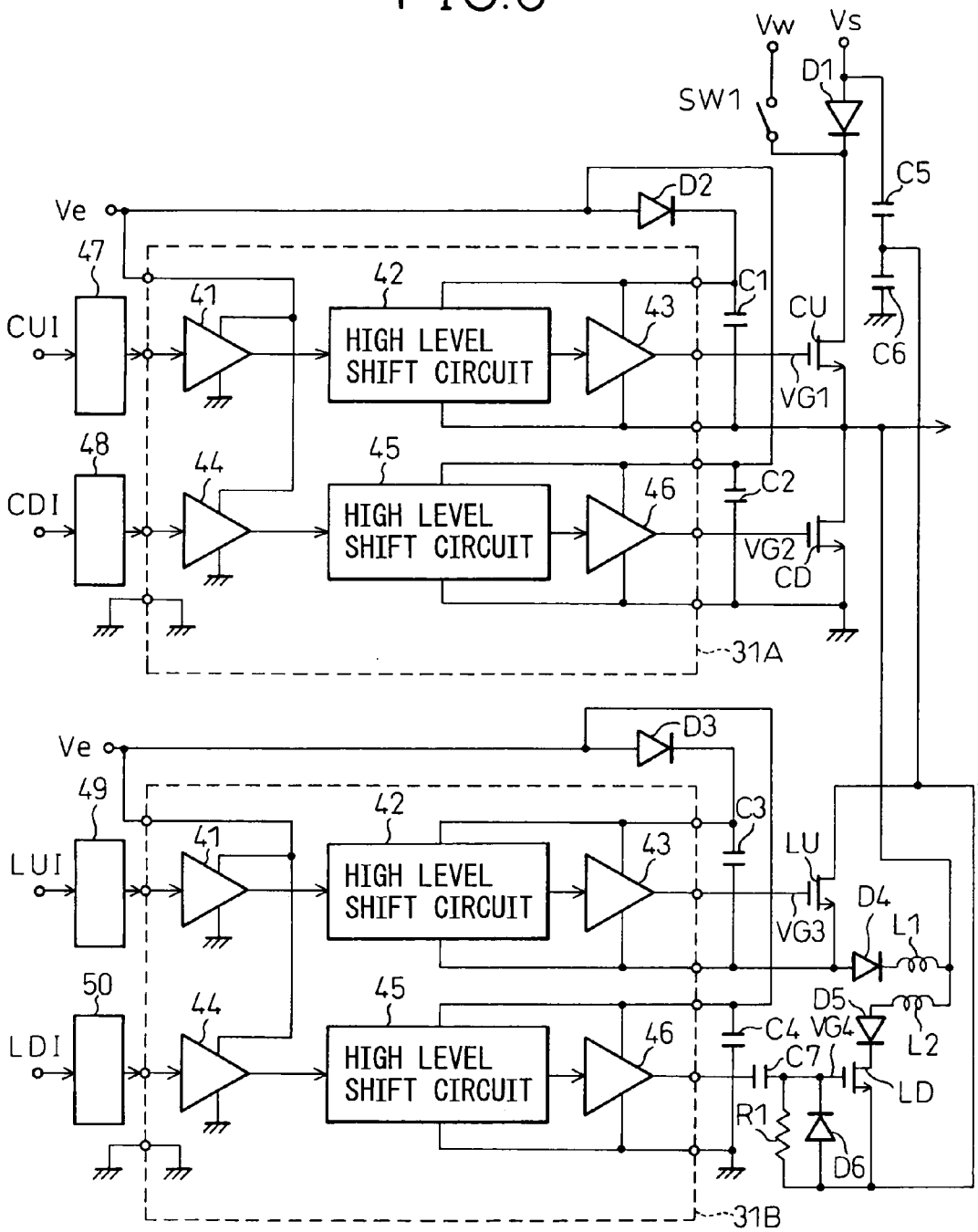
FIG. 8 is a diagram showing the constitution of a sustain circuit in a third embodiment of the present invention.

FIG. 8 shows the constitution of a sustain circuit of a plasma display apparatus in a third embodiment of the present invention. As shown schematically, the sustain circuit in the third embodiment differs from the sustain circuit in the second embodiment in that input and output delay time adjusting circuits 47 to 50 are provided at the inputs of each input voltage signal CUI, CDI, LUI and LDI. The input and output delay time adjusting circuits 47 to 50 absorb the variations in the input and output delay times of the pre-drive circuit and serve to reduce the differences in the rise times or fall times between CUI and VG1, between CDI and VG2, between LUI and VG3, and between LDI and VG4.

Figure 9:
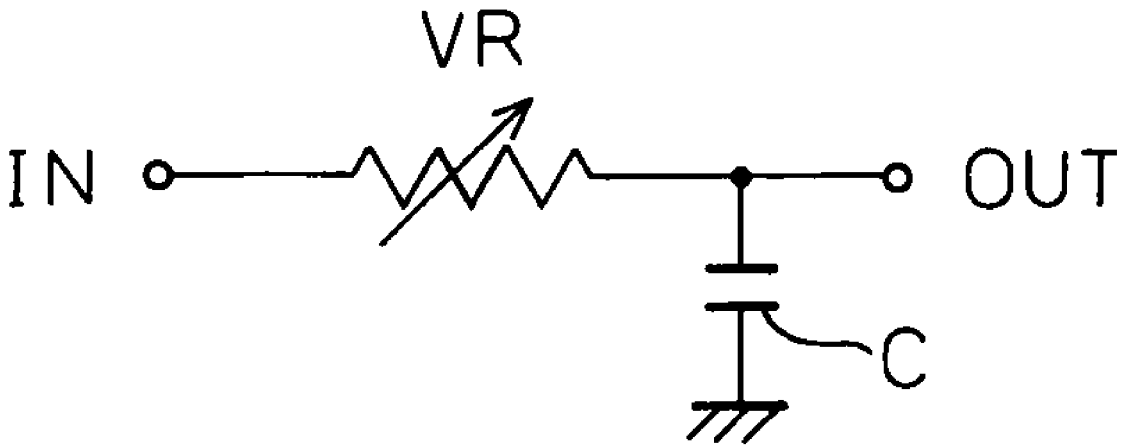
FIG. 9 is a diagram showing an example of an input and output delay time adjusting circuit.

The input and output delay time adjusting circuit can be realized, for example, by a delay circuit consisting of a variable resistor VR and a capacitor C shown in FIG. 9. As the constitution of the input and output delay time adjusting circuit has been disclosed in Japanese Unexamined Patent Publication (Kokai) No. 2001-282181, a detailed description is not given here.

Moreover, in the pre-drive circuit used in the third embodiment, threshold voltages of the first input amplifier circuit 41 and the second input amplifier circuit 42 are set to be almost equal to an intermediate voltage VI/2 of the source voltage. By this, a change of the pulse width, which is generated by providing the input and output delay time adjusting circuit, can be reduced.

In the circuit in the third embodiment, it is possible to reduce variations in the input and output delay times before they are adjusted in the input and output delay time adjusting circuit by using the pre-drive circuit in the first embodiment shown in FIG. 4. As a result, it is possible to reduce the adjustable range of the input and output delay time adjusting circuit. For example, when a delay circuit shown in FIG. 9 is used as an input and output delay time adjusting circuit, it is possible to reduce the variable range of the resistor. Therefore, when the delay time is varied by trimming the resistance value of the variable resistor VR and varying the resistance value, it is possible to further reduce the minimum adjustable amount of the delay time which can be set by the unit trimming amount. As a result, a more precise setting of the delay time is made possible.

Moreover, it is possible to reduce the number of defective parts which are judged to be out of specifications because of the variations in parts by reducing the adjustable range of the input and output delay time adjusting circuit, and the productivity can be increased.

Figure 10:
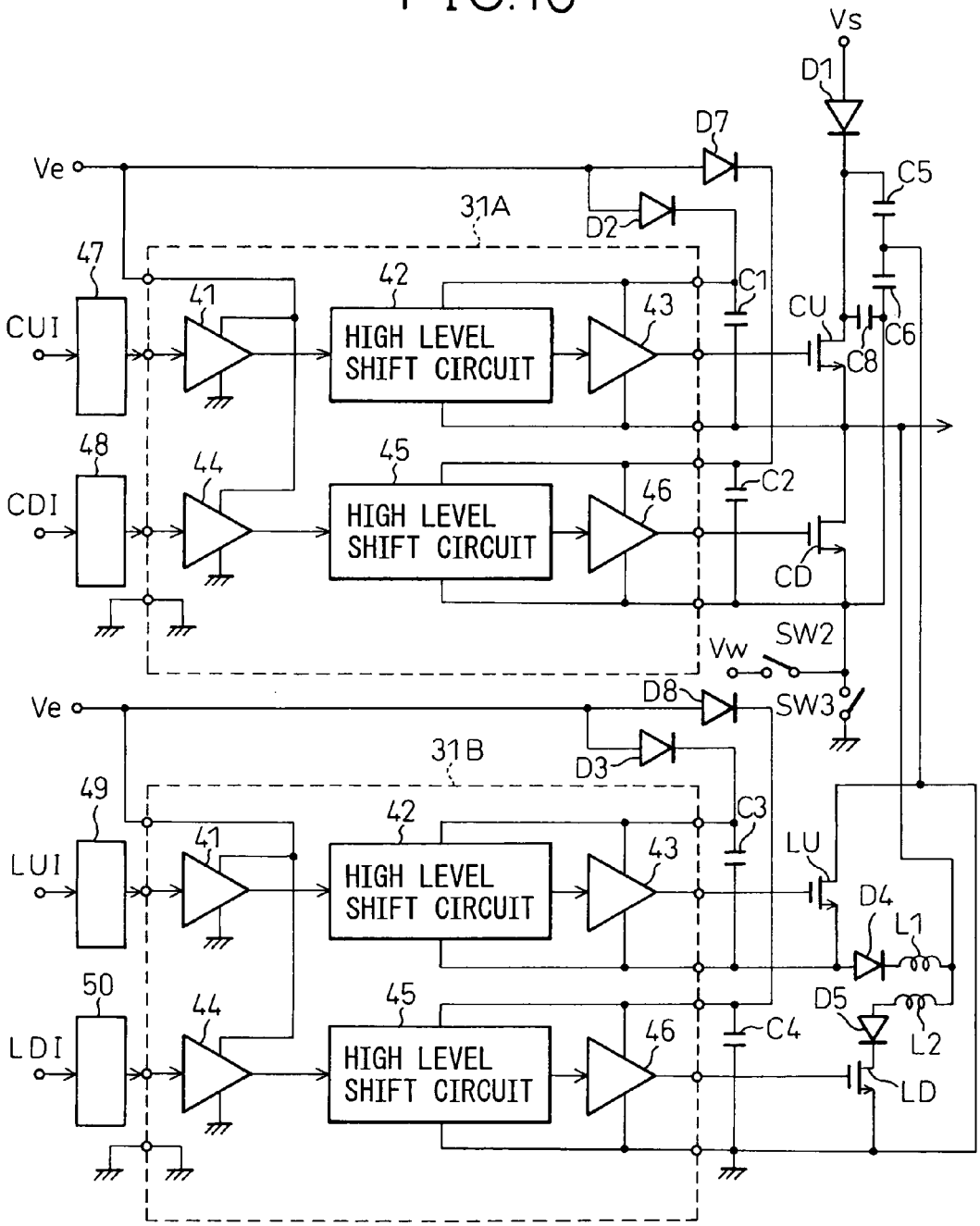
FIG. 10 is a diagram showing the constitution of a sustain circuit in a fourth embodiment of the present invention.

FIG. 10 shows the constitution of a sustain circuit of a plasma display apparatus in a fourth embodiment of the present invention. As shown schematically, the sustain circuit in the fourth embodiment differs from the sustain circuit in the third embodiment in that the reset power supply source is connected to the reference voltage side of the output element CD. As shown in FIG. 10, the reference voltage side (side not to be connected to PDP) of the output element CD is connected to the power supply source of the voltage Vw' via a switch SW2, and to the GND via a switch SW3. The terminal on the side of the capacitor C6 not to be connected to C5 is connected to the power supply side of the output element CU via a capacitor C8. As a matter of course, the switch SW1 is removed. When the reset voltage Vw is applied to the PDP, the switch SW2 is turned on after the output element CU is turned on and the switch SW 3 is turned off. Because of this, the voltage at the terminal of the capacitor C8 changes from the GND to Vw', and Vw' is superimposed on the voltage on the power supply side of the output element CU to become the reset voltage Vs+Vw' (=Vw). This reset voltage Vs+Vw' is applied to the PDP via the output element CU. At this time, as the reset voltage Vs+Vw' and Vw' are applied to both sides of the output element CD, the voltage applied across the output element CD is Vs and there is an advantage that an output element CD with a relatively small withstand voltage can be used.

The constitution, in which Vw' is superimposed on Vs and thus the reset voltage Vs+Vw' is generated, has been disclosed in detail in Japanese Unexamined Patent Publication (Kokai) No. 2002-351388.

The sustain circuit in the fourth embodiment can be further characterized in that the voltage Vw' can be applied to the reference voltage side of the output element CD compared to the case where the circuit in the first embodiment shown in FIG. 7 is used as a pre-drive circuit. In the conventional pre-drive circuit shown in FIG. 3, the reference voltage side of the output element CD is connected to the GND and the low side reference voltage of the pre-drive circuit is also connected to the GND. Moreover, when the conventional pre-drive circuit is constituted using an IC, it is connected to the GND of the input section within the IC or connected to the substrate within the IC. Therefore, in the conventional pre-drive circuit shown in FIG. 3, it was impossible to raise the low side reference voltage higher than the GND. As a result, it was impossible to superimpose the voltage Vw' on the reference voltage side of the output element CD.

In contrast, an output reference voltage terminal RV2 in the pre-drive circuit in the first embodiment shown in FIG.

4 is not connected to the GND within the IC. Moreover, it is not connected to the substrate within the IC. Therefore, it is possible to superimpose the voltage Vw' on the output reference voltage terminal Vw'.

Generally, the reset voltage Vw is higher than the supply voltage Vs of the sustain circuit. Therefore, in the sustain circuit shown in FIG. 8, as the reset voltage Vw was supplied to the PDP from the power supply side of the output element CU, it was necessary to use an element with a high rated voltage corresponding to the reset voltage as the output element CD. In contrast, in the sustain circuit in the fourth embodiment shown in FIG. 10, as the voltage Vw' is supplied from the reference voltage side of the output element CD, it is possible to reduce the voltage applied across the output element CD. Therefore, it is possible to use a low-cost element whose rated voltage is low and whose chip size is small.

Figure 3:
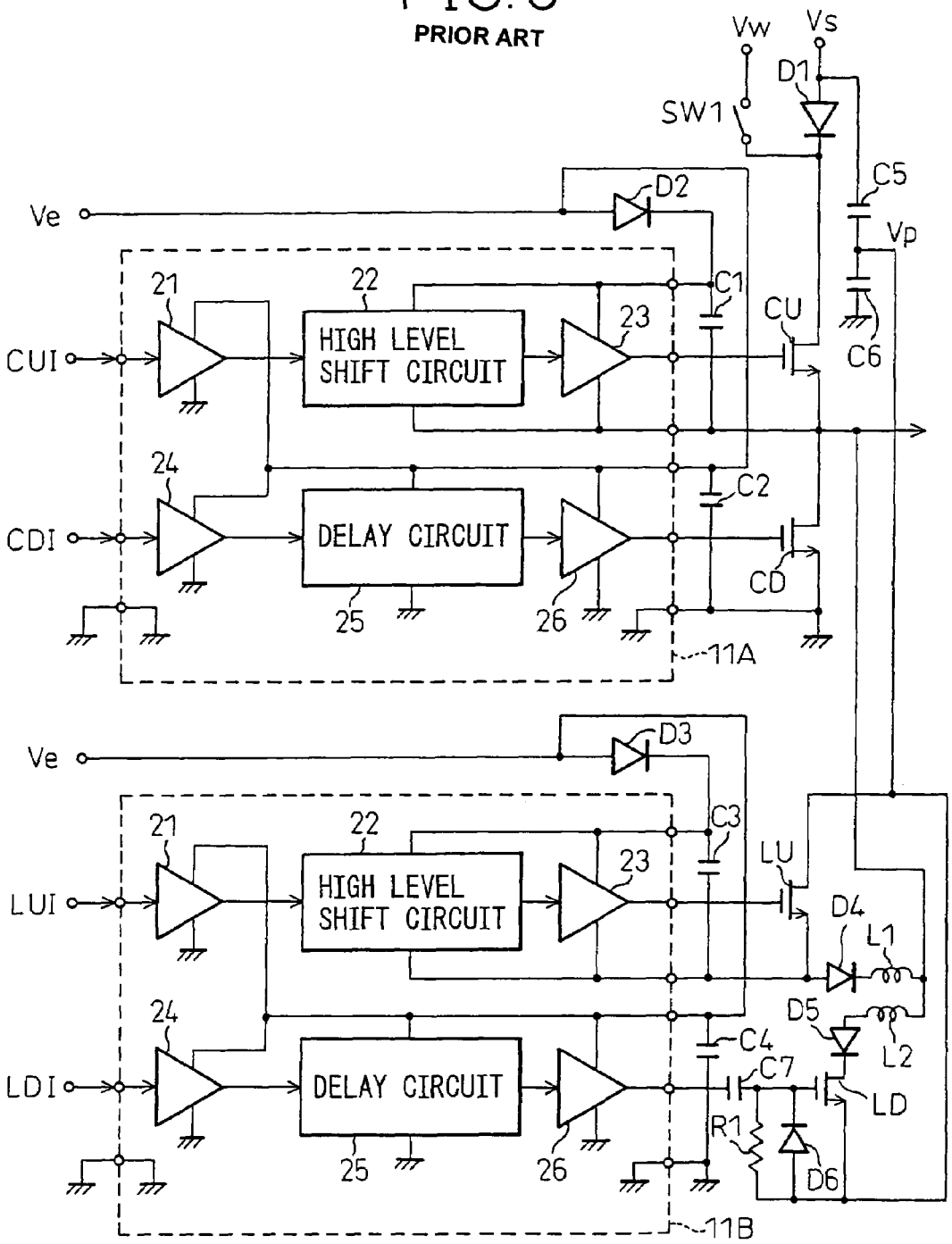
FIG. 3 PRIOR ART
FIG. 3 is a diagram showing the constitution of a sustain circuit of a conventional plasma display apparatus.

In the circuit shown in FIG. 10, a capacitor C7, a resistor R1 and a diode D6 used in FIG. 3 are eliminated. By using the pre-drive circuit in the first embodiment shown in FIG. 4, it is possible to shift a level of the gate pulse for driving the power recovery output element LD to a pulse referred to the reference voltage of LD (voltage Vp). Because of this, it is possible to eliminate the capacitor C7, the resistor R1 and the diode D6. When the conventional pre-drive circuit shown in FIG. 2 is used, as the low side reference voltage terminal is connected to the GND within the IC, a level shift circuit made up of the capacitor C7, the resistor R1 and the diode D6 is required. The effect that such a level shift circuit can be eliminated is obtained by the use of the pre-drive circuit in the first embodiment shown in FIG. 4.

Figure 11:
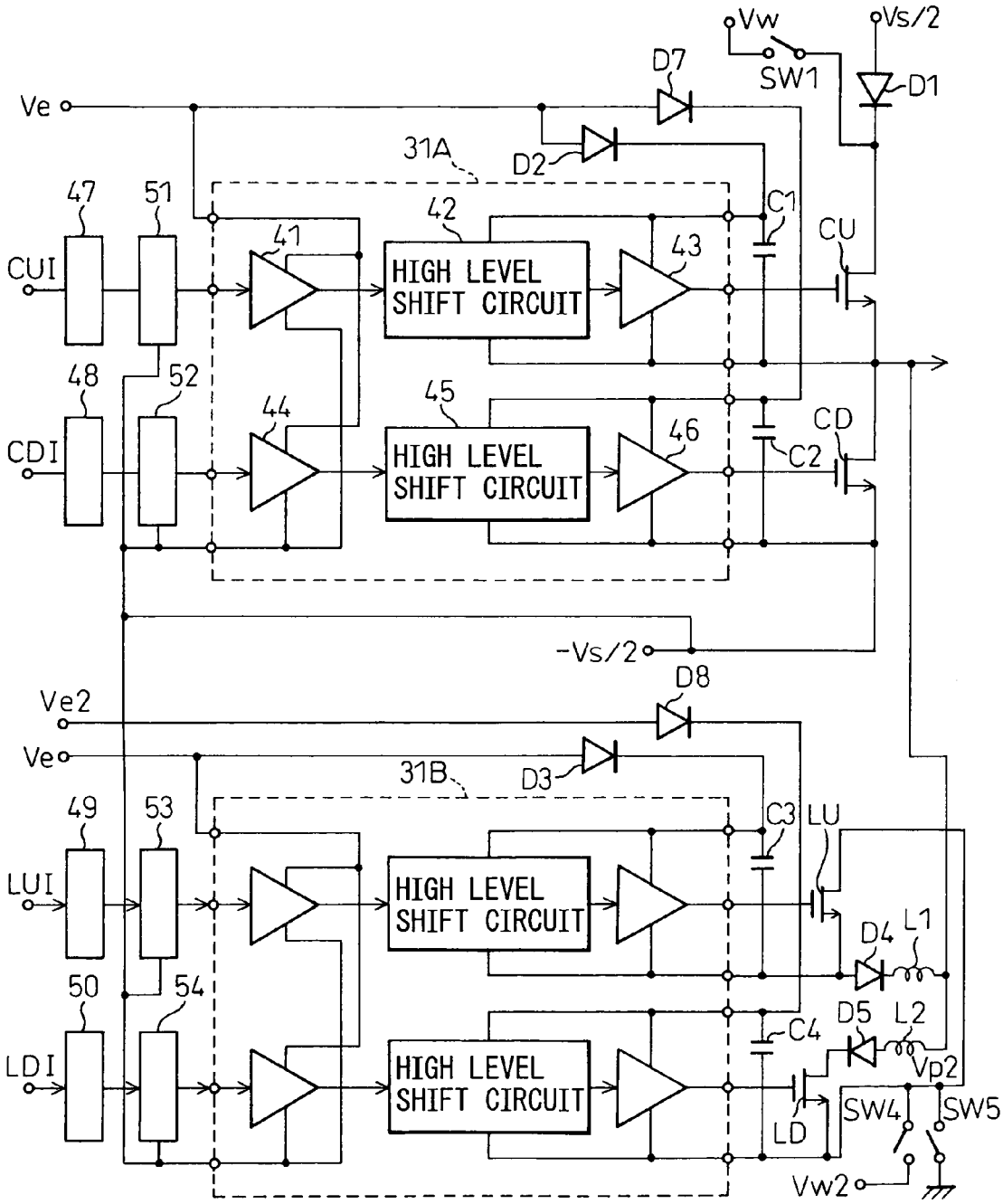
FIG. 11 is a diagram showing the constitution of a sustain circuit in a fifth embodiment of the present invention.

FIG. 11 shows the constitution of a sustain circuit of a plasma display apparatus in a fifth embodiment of the present invention. The sustain circuit in the fifth embodiment is another example of the sustain circuit which uses the pre-drive circuit in the first embodiment. In the sustain circuit in the fifth embodiment, two voltages Vs/2 and −Vs/2 are used as a supply voltage in the sustain circuit. In the circuit shown in FIG. 11, Vs/2 is supplied to the PDP by turning on CU and −Vs/2 is supplied to the PDP by turning on CD. At this time, the reference voltage of CD is −Vs/2. In the circuit shown in FIG. 11, input level shift circuits 51 to 54 are used in order to convert a signal to be supplied to the input terminal of the pre-drive circuit into a signal referred to the voltage −Vs/2. On the other hand, in the circuit shown in FIG. 11, the capacitors C5 and C6 used in FIG. 10 are eliminated and the GND voltage is used as a power recovery voltage Vp2. During the sustain operation, a switch SW5 is turned on and the voltage Vp becomes the GND voltage. During the reset period, the switch SW5 is turned off and the switch SW1 and the SW4 are turned on. As a result, when the reset voltage Vw is supplied to the PDP via CU, the voltage Vw2 is supplied to the reference voltage terminal of LD at the same time. By supplying the voltage Vw2 to the reference voltage terminal of LD by using the switches SW4 and SW5, it is possible to reduce the voltage applied across the output element LD and to use an element (small in chip size and low cost) with a low rated voltage as LD. The constitution, in which the rated voltage of LD is reduced by using the switches SW4 and SW5, has been disclosed in Japanese Patent Application No. 2002-141845.

In the circuit in the fifth embodiment shown in FIG. 11, the circuit shown in FIG. 4 as a pre-drive circuit is used. In the conventional pre-drive circuit, as the low level reference voltage is connected to the reference voltage on the input side, the reference voltage of LD cannot be made higher than the input side reference voltage. In contrast, by applying the pre-drive circuit shown in FIG. 4, the reference voltage of LD can be made higher than the input side reference voltage −Vs/2.

It is possible to form the input level shift circuit within the IC together with the pre-drive circuit in the first embodiment.

As shown in FIG. 11, in the sustain circuit in which Vs/2 and −Vs/2 are used as a sustain voltage, the capacitors C5 and C6 for power recovery can be eliminated. In addition, by using the switches SW4 and SW5, it is possible to use an element with a small rated voltage as an LD.

Figure 12:
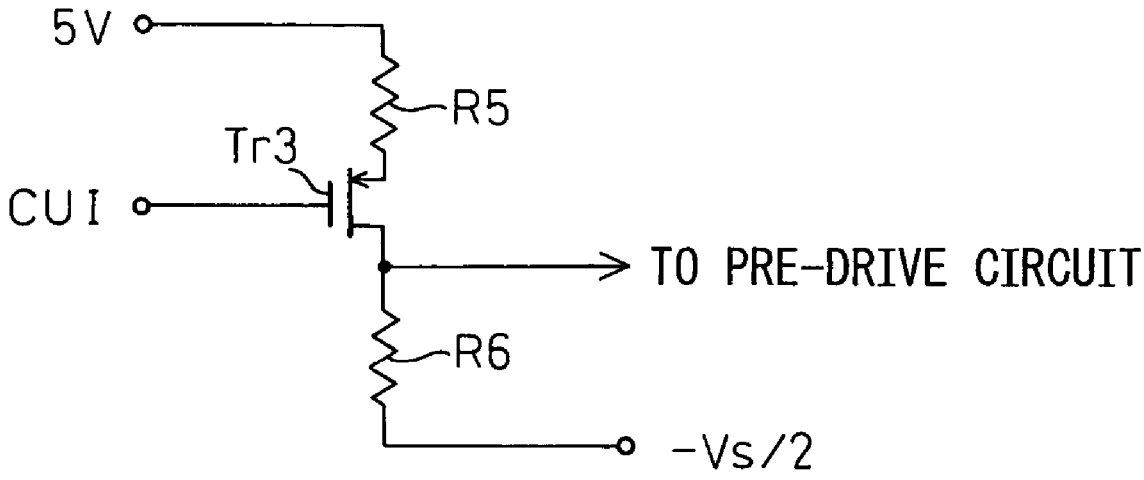
FIG. 12 is a diagram showing a constitution example of an input level shift circuit.

FIG. 12 is a diagram showing an example of the constitution of an input level shift circuit. As shown schematically, this circuit is a circuit in which a transistor Tr3 is connected between an input supply voltage 5V and −Vs/2 via resistors R5 and R6. As the input level shift circuit is widely known, a detailed description is not given here.

Figure 13:
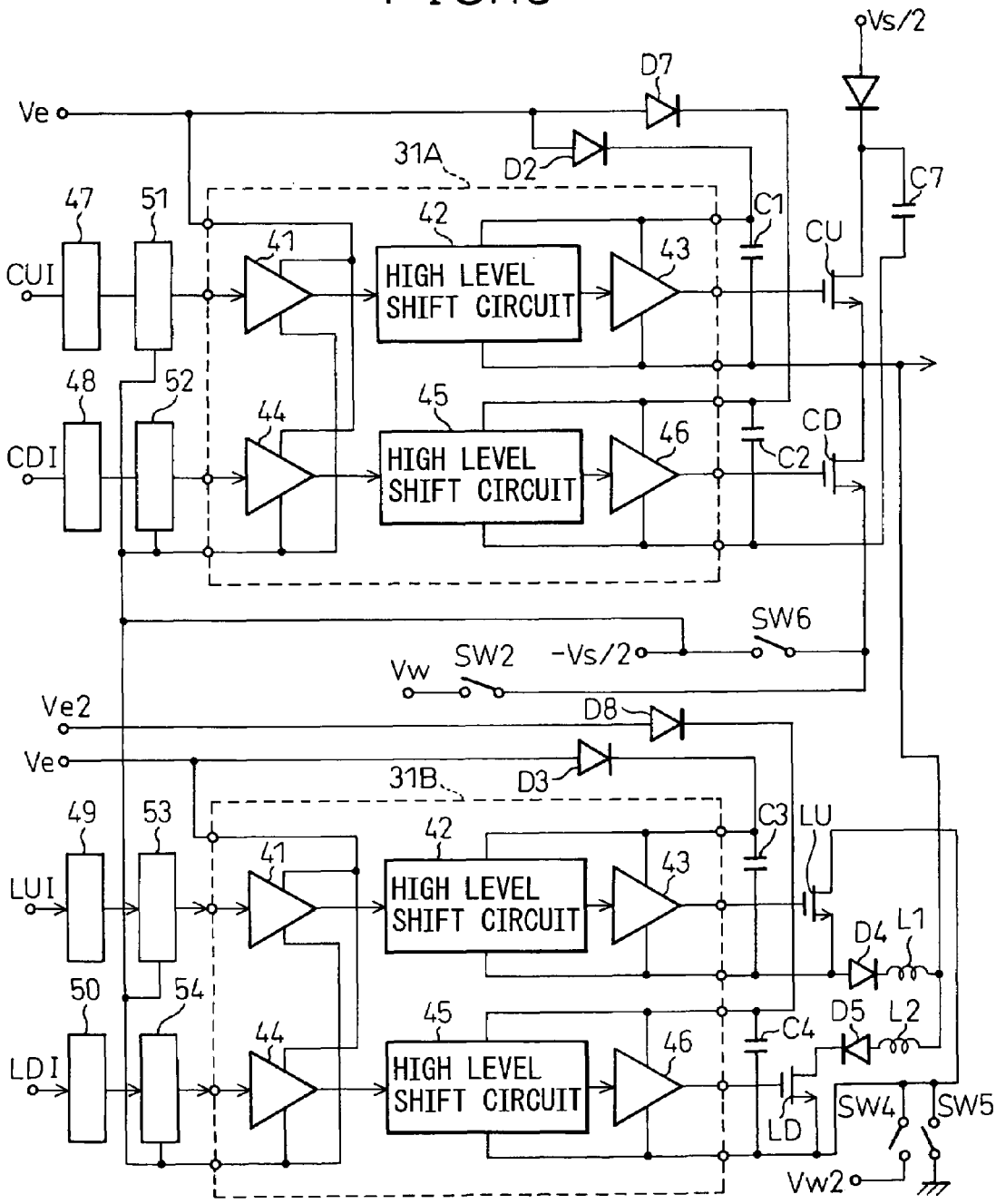
FIG. 13 is a diagram showing the constitution of a sustain circuit in a sixth embodiment of the present invention.

FIG. 13 shows the constitution of a sustain circuit of a plasma display apparatus in a sixth embodiment of the present invention. The sustain circuit in the sixth embodiment differs from the sustain circuit in the fifth embodiment in that the reset voltage source is connected to the reference voltage side of the output element CD. The advantage of the constitution in which the reset voltage source is connected to the reference voltage side of the output element CD is the same as that described in the fourth embodiment.

Figure 14:
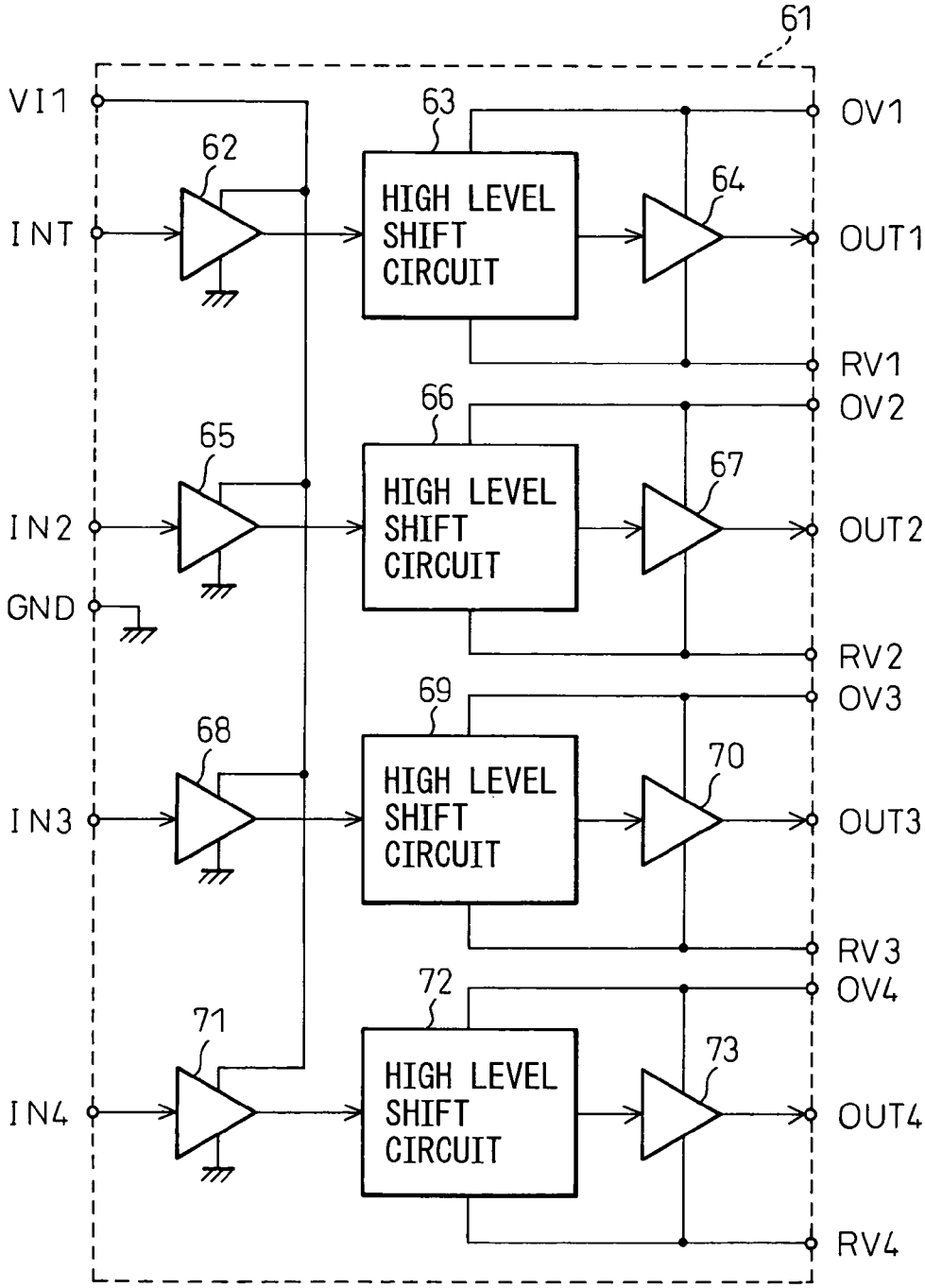
FIG. 14 is a diagram showing the constitution of a pre-drive circuit in a seventh embodiment of the present invention.

FIG. 14 is a diagram showing the constitution of a pre-drive circuit in a seventh embodiment of the present invention. The pre-drive circuit in the seventh embodiment is characterized by having four drive systems, four inputs and four outputs. Each drive system has an identical circuit constitution, which is the same as each drive system in the pre-drive circuit in the first embodiment. Therefore, according to the principle described in FIGS. 5A to 5C, it is possible to reduce the difference in the input and output delay times (difference in rise times, difference in fall times) of each circuit.

Figure 15:
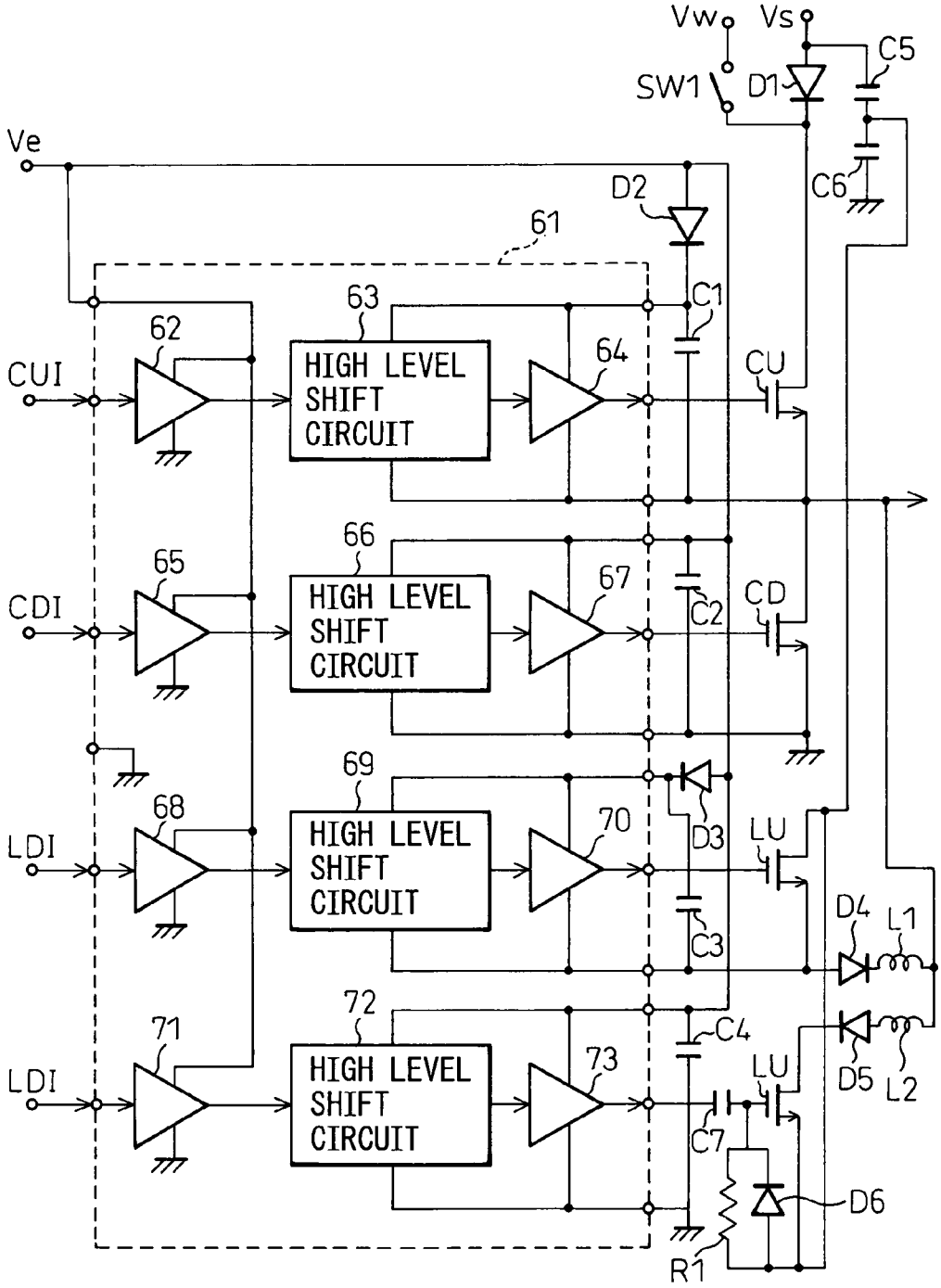
FIG. 15 is a diagram showing the constitution of a sustain circuit in an eighth embodiment of the present invention.

FIG. 15 shows the constitution of a sustain circuit in a plasma display apparatus in an eighth embodiment of the present invention. As shown schematically, the sustain circuit in the eighth embodiment differs from the conventional sustain circuit shown in FIG. 3 in that the pre-drive circuit in the seventh embodiment is used as a pre-drive circuit for driving the output elements CU, CD, LU and LD. By using the pre-drive circuit in the seventh embodiment, the output elements CU, CD, LU and LD can be driven by one pre-drive circuit. Therefore, it is possible to prevent destruction due to the deviation of timing with which the output elements CU and CD are turned on and off and an abnormal power recovery operation due to the deviation of timing with which the output elements LU and LD are turned on. Particularly, when four drive systems are build into an IC, it is possible to more precisely adjust the difference in timings with which LU and CU, and LD and CD are turned on. Therefore, the power recovery operation can be performed more precisely. Although not shown in FIG. 15, the input and output delay time adjusting circuits 47 to 50 are provided in the previous stage of the input terminal as shown in FIG. 10, it is possible to more precisely set the input and output delay time by reducing the adjustable range.

Figure 16:
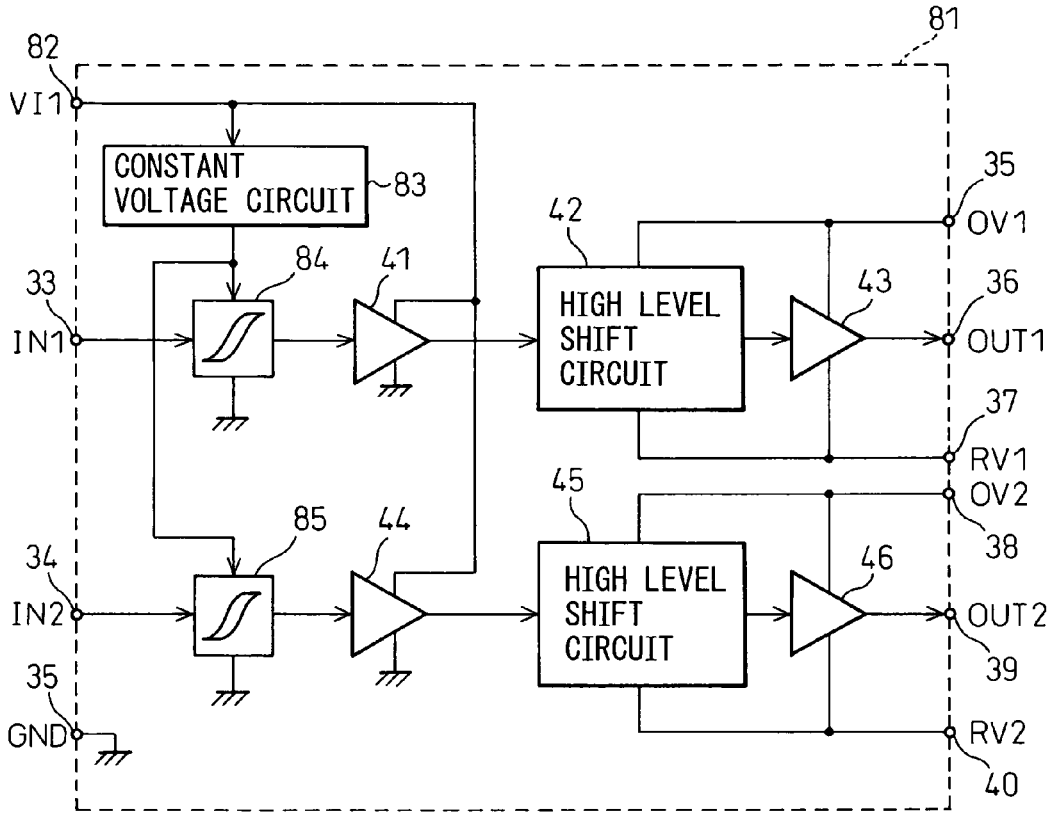
FIG. 16 is a diagram showing the constitution of a pre-drive circuit in a ninth embodiment of the present invention.

FIG. 16 is a diagram showing the constitution of a pre-drive circuit in a ninth embodiment of the present invention. The pre-drive circuit in the ninth embodiment differs from the pre-drive circuit in the first embodiment shown in FIG. 4 in that Schmitt trigger circuits 84 and 85 are provided immediately after the input terminal. There are some cases where the supply voltage of the Schmitt trigger circuits 84 and 85 must be different from that of the input amplifier circuits 41 and 44, therefore, a constant voltage circuit 83 is provided in the pre-drive circuit in the ninth embodiment and by the use of the constant voltage circuit 83, the supply voltage of the Schmitt trigger circuits 84 and 85 is generated from the supply voltage VI1 of the input amplifier circuits 41 and 44. It is also possible to input the supply voltage of the Schmitt trigger circuits 84 and 85 by providing an input terminal separately, but if the constant voltage circuit 83 is built in the pre-drive circuit as shown in FIG. 16, the effect that the input terminal can be eliminated is brought about. Moreover, by forming a pre-drive circuit having the built-in constant voltage circuit 83 within an IC, the circuit size can be reduced. Even when a circuit other than the Schmitt trigger circuit, such as a waveform processing circuit, the supply voltage of which is different from that of the input amplifier circuits 41 and 44, is used, the input terminal can be eliminated and the circuit size can be reduced by providing a constant voltage circuit in the pre-drive circuit.

As shown in FIG. 16, by providing the Schmitt trigger circuit in the pre-drive circuit, the effect is brought about that even if noises are contained in the input voltage, the noises can be removed and the output elements to be connected to the output terminal can be driven properly.

Figure 17:
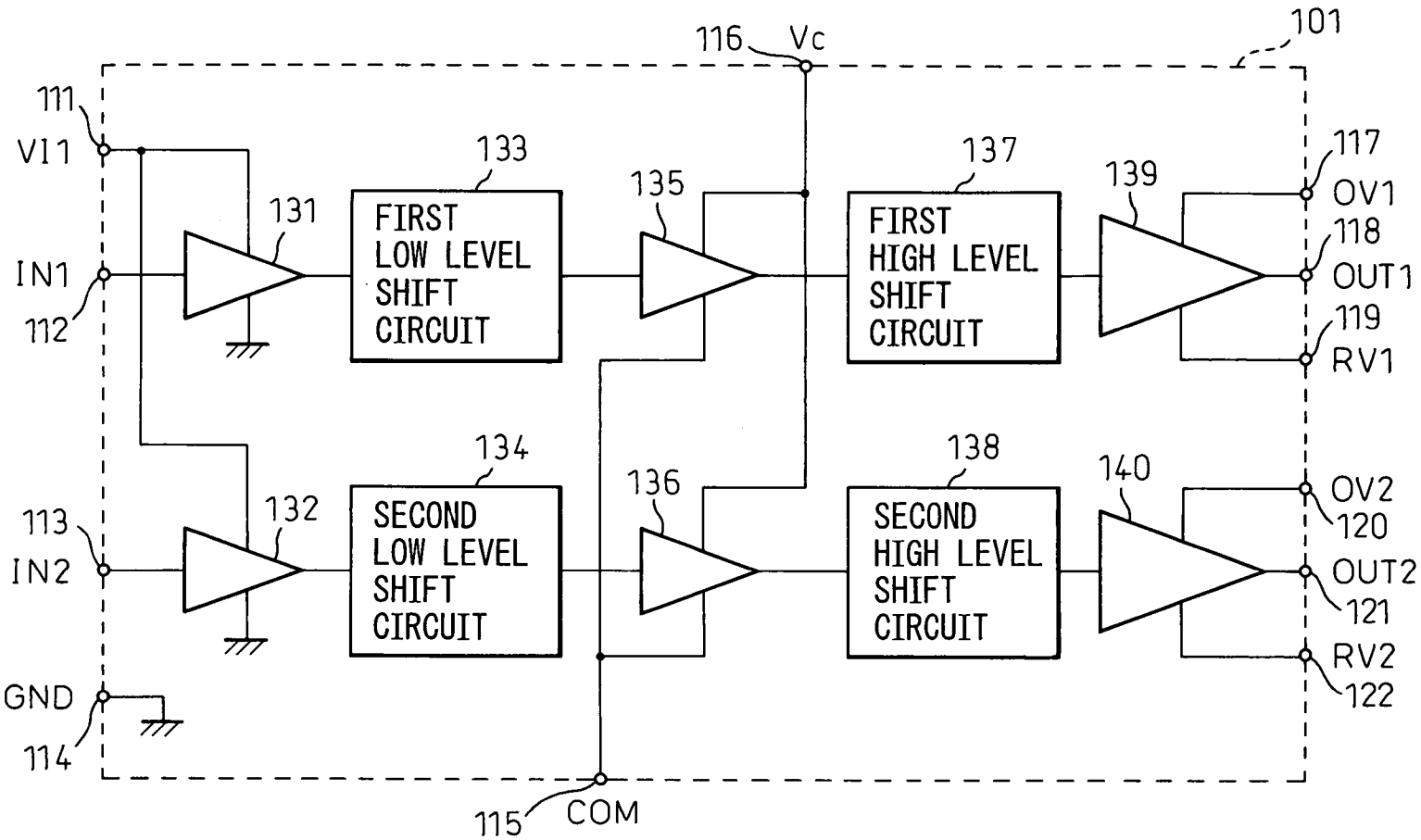
FIG. 17 is a diagram showing the constitution of a pre-drive circuit in a tenth embodiment of the present invention.

FIG. 17 is a diagram showing the constitution of a pre-drive circuit in a tenth embodiment of the present invention. The pre-drive circuit of the tenth embodiment is used when the low level reference voltage is negative. As shown in the figure, the pre-drive circuit of the tenth embodiment includes first and second input amplifier circuits 131 and 132, first and second low level shift circuits 133 and 134, first and second waveform processing circuits 135 and 136, first and second high level shift circuits 137 and 138, and first and second output amplifier circuits 139 and 140. These circuits constitute a pair of drive systems of same constitution. In other words, the pre-drive circuit of the tenth embodiment is characterized in that the low level shift circuit and the waveform processing circuit are provided between the input amplifier circuit and the high level shift circuit of each drive system of the pre-drive circuit of the first embodiment shown in FIG. 4.

The first and second low level shift circuits 133, 134 respectively shift the outputs of the first and second input amplifier circuits 131 and 132 to signals referred to the negative reference voltage. The waveform processing circuits 135 and 136 are connected to a negative reference voltage input terminal 115, to which a negative reference voltage COM is input, and a negative supply voltage input terminal 116, to which a negative source supply voltage Vc generated referred to the negative reference voltage COM is input and the waveform processing circuits process respective output signals of the first and second low level shift circuits 133 and 134.

As the pre-drive circuit of the tenth embodiment includes the low level shift circuits and the waveform processing circuits in addition to the constitution of the first embodiment, as described with reference to FIGS. 5A to 5C, the difference of input and output delay time between the two drive paths can be reduced.

Figure 18:
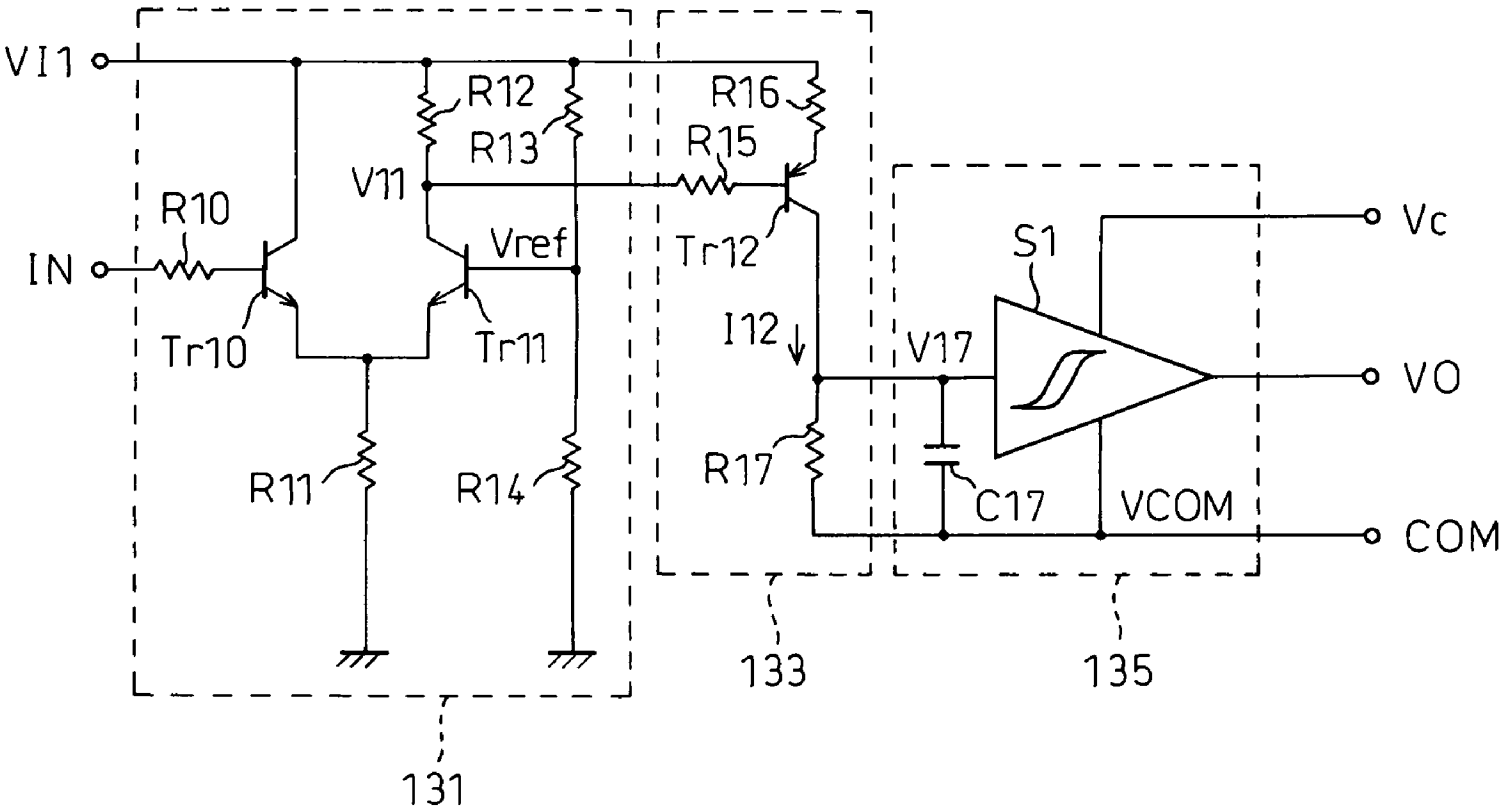
FIG. 18 is a diagram showing a specific constitution of the pre-drive circuit in the tenth embodiment.

FIG. 18 is a diagram showing a concrete constitution of the first input amplifier circuit 131, the first low level shift circuit 133 and the first waveform processing circuit 135 in the tenth embodiment. The second input amplifier circuit 132, the second low level shift circuit 134 and the second waveform processing circuit 136 also have the same constitution. As shown in the figure, the first input amplifier circuit 131 is a current-mirror circuit which is constituted by transistors Tr10, Tr11 and resistors R10–R14. The first input amplifier circuit 131 generates a voltage V11, at a collector terminal of the transistor Tr11, according to a difference voltage between a base voltage of the transistor Tr10, which is obtained from the input signal IN via the resistor R10, and a voltage Vref, which is obtained by dividing a voltage VI1 by the resistors R13 and R14.

The first low level shift circuit 133 is constituted by a transistor Tr12 and resistors R15–R17. In the first low level shift circuit 133, the voltage V11 output from the first input amplifier circuit 131 is supplied to a base terminal of the transistor Trl2 via the resistor R15, a collector current of the transistor 12 is changed according to the voltage V11, and a voltage (V17-VCOM) generated at both ends of the resistor R17 is also changed.

The first waveform processing circuit 135 is constituted by a capacitor C17 and a Schmitt trigger circuit S1. A combined resistance of the output impedance of the transistor Trl2 and the resistor R17 and the capacitor C17 form an integrating circuit. This integrating circuit decreases noise components generated at both ends of the resistor R17. Further, the Schmitt trigger circuit S1 makes a hysteresis between thresholds in a change of the output when a voltage between both ends of the resistor R17 increases and decreases. As the result, the generation of an erroneous operation due to the noises generated at both ends of the resistor R17 can be reduced.

Figure 19:
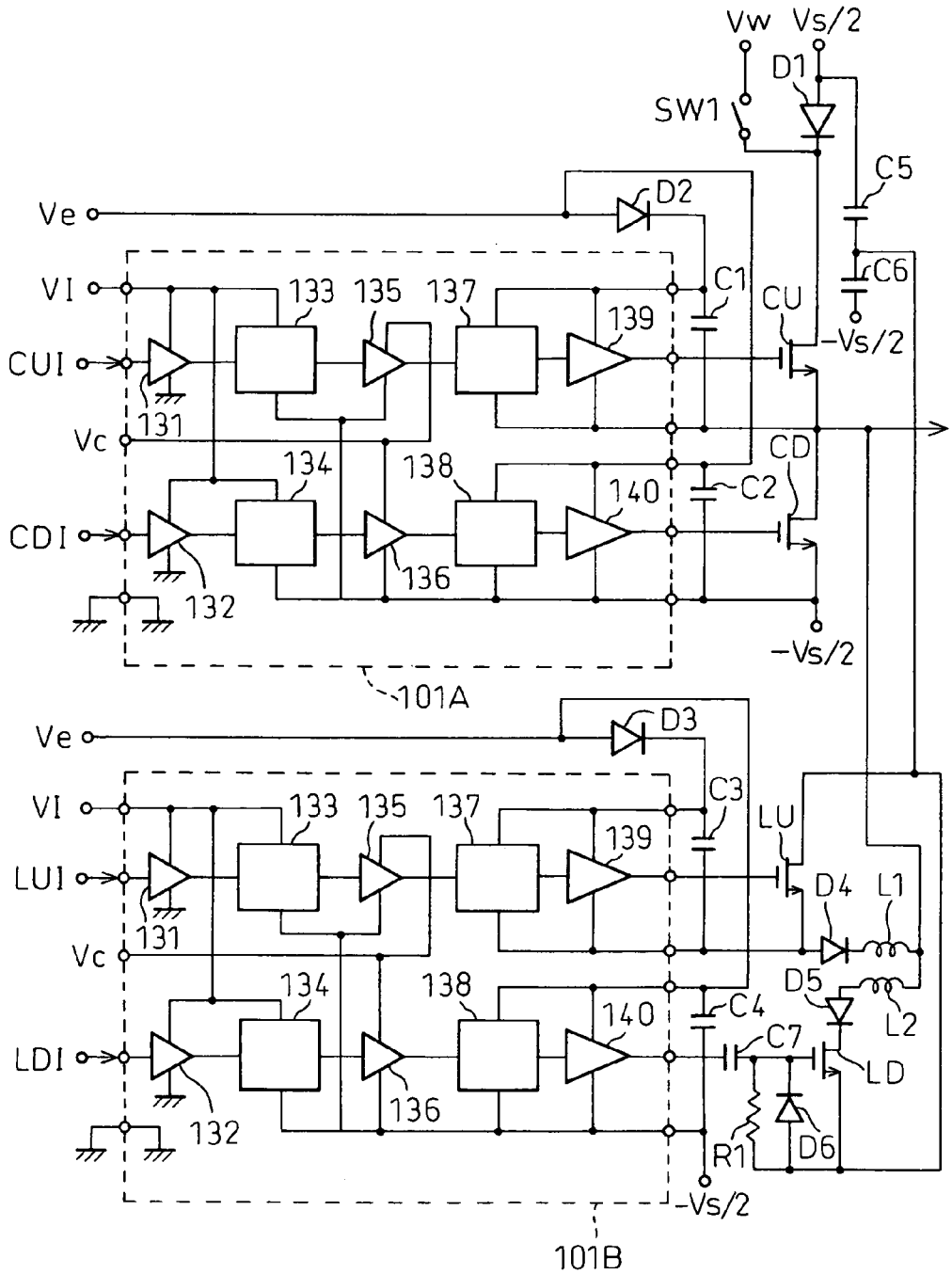
FIG. 19 is a diagram showing the constitution of a sustain circuit in an eleventh embodiment of the present invention.

FIG. 19 is a diagram showing the constitution of a sustain circuit of a plasma display apparatus in an eleventh embodiment of the present invention. The sustain circuit of the eleventh embodiment is a circuit which has the sustain voltages of Vs/2 and −Vs/2 and is realized by using the drive circuit of the tenth embodiment. As shown schematically, the sustain circuit in the eleventh embodiment has a constitution similar to that of the sustain circuit of the fifth embodiment shown in FIG. 11, but differs in that the input and output delay time adjusting circuits 47 to 50 and the input level shift circuits 51 to 54 are eliminated, and the pre-drive circuit of the tenth embodiment is used. As the level shift circuits are provided in the IC, the difference between the input and output delay times can be further reduced in comparison with the sustain circuit of the fifth embodiment. Other constitutions except that the input and output delay time adjusting circuit is not provided are similar to those of the sustain circuit of the fifth embodiment and, therefore, more detailed descriptions are omitted.

Figure 20:
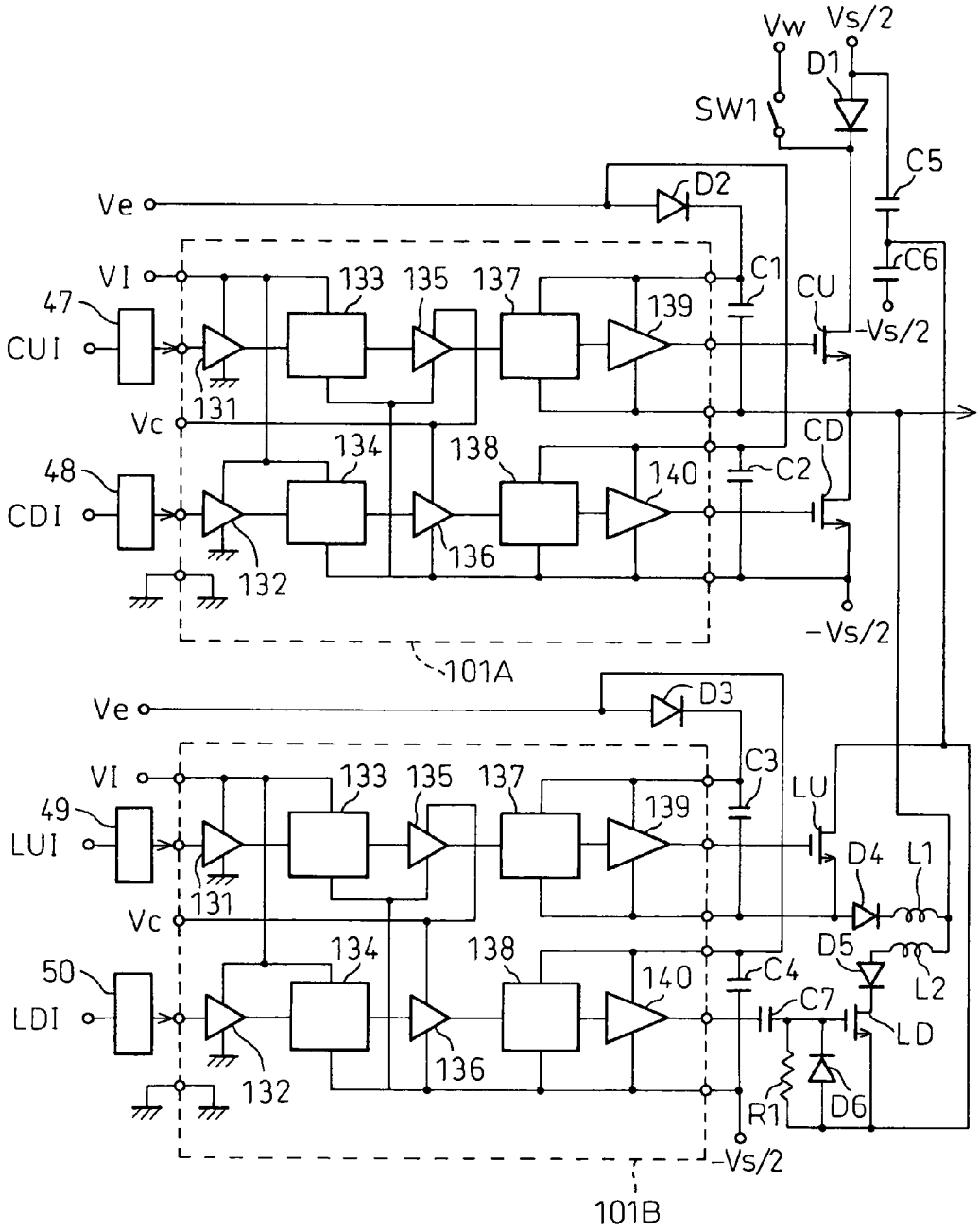
FIG. 20 is a diagram showing the constitution of a sustain circuit in a twelfth embodiment of the present invention.

FIG. 20 is a diagram showing the constitution of a sustain circuit of a plasma display apparatus in a twelfth embodiment of the present invention. The sustain circuit of the twelfth embodiment has a constitution in which input and output delay time adjusting circuits 47 to 50 are provided in the sustain circuit of the eleventh embodiment. In this constitution, threshold voltages of the input amplifier circuits 131 and 132 are set to be almost a half of the source voltage VI of the input amplifier circuit. For example, this condition is realized by setting the resistances of the resistors R13 and R14 in FIG. 18 equal. By this condition, a change of pulse width generated at the input and output delay time adjusting circuits 47 to 50 can be reduced. The detailed description of this principle is made in Japanese Patent Application No. 2003-106839.

Figure 21:
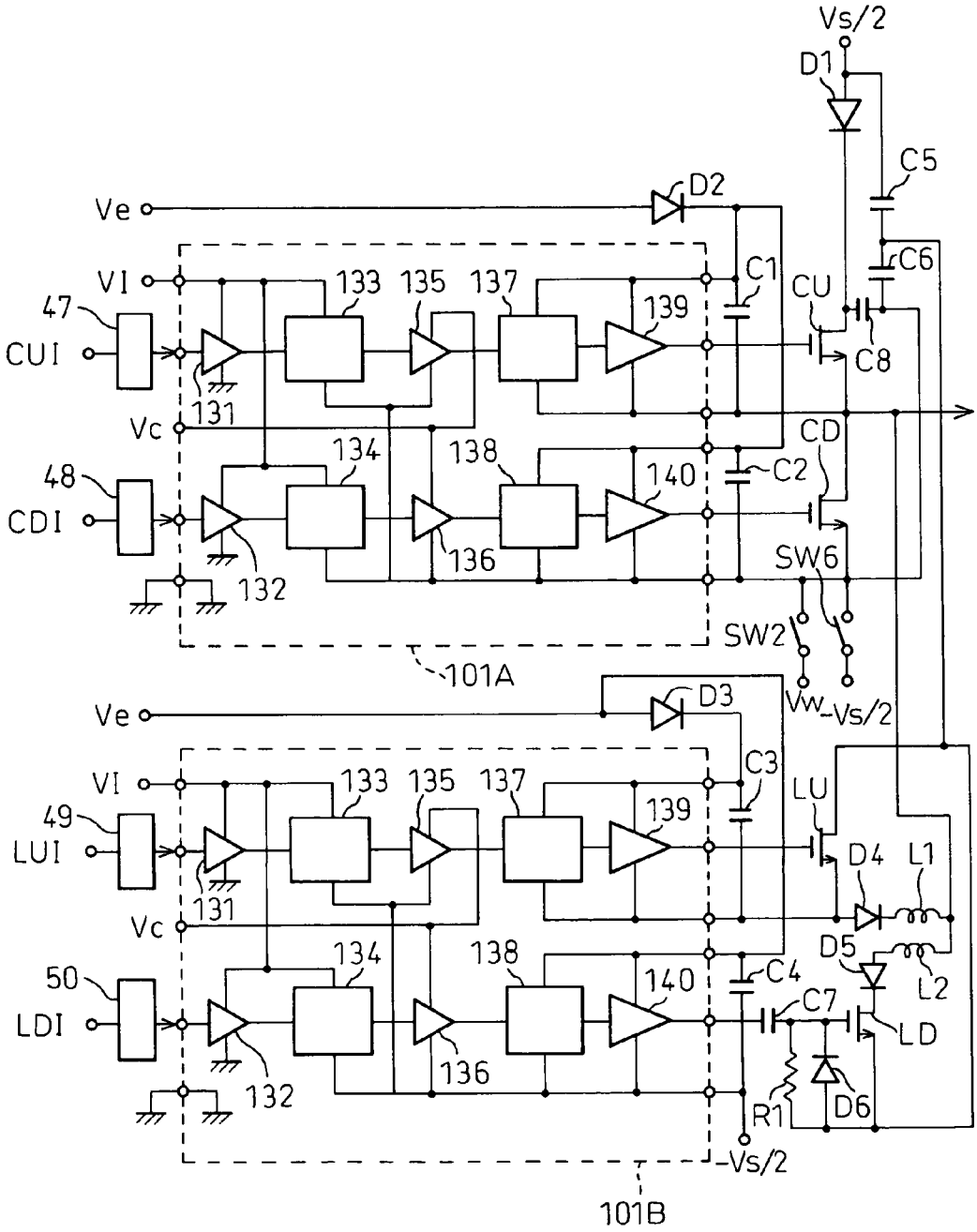
FIG. 21 is a diagram showing the constitution of a sustain circuit in a thirteenth embodiment of the present invention.

FIG. 21 is a diagram showing the constitution of a sustain circuit of a plasma display apparatus in a thirteenth embodiment of the present invention. The sustain circuit of the thirteenth embodiment has a constitution similar to that of the sustain circuit of the twelfth embodiment, but differs in that the switch SW1 is eliminated, and a reset voltage Vw is overlaid at a source terminal of the second switch element CD via the switch SW2. The switch SW 6 is turned off when the switch SW2 is turned on. The operation of this constitution is similar to that of the sixth embodiment shown in FIG. 13 and, therefore, more detailed descriptions are omitted.

Figure 22:
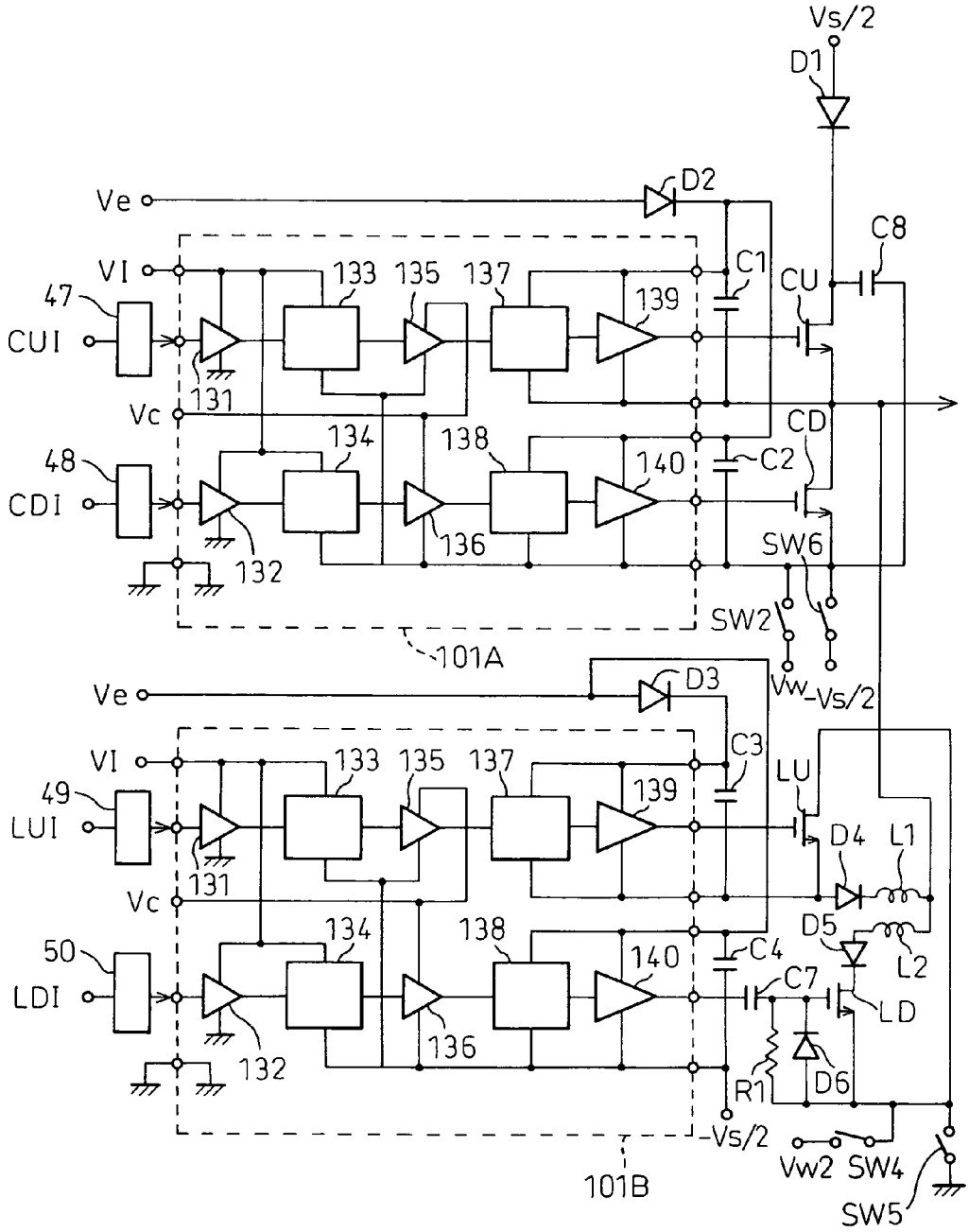
FIG. 22 is a diagram showing the constitution of a sustain circuit in a fourteenth embodiment of the present invention.

FIG. 22 is a diagram showing the constitution of a sustain circuit of a plasma display apparatus in a fourteenth embodiment of the present invention. The sustain circuit of the fourteenth embodiment has a constitution similar to that of the sustain circuit of the thirteenth embodiment, but differs in that the switches SW4 and SW5 are added. In this constitution, similar to the fifth and sixth embodiments, the voltage VW2 is applied to the supply voltage terminal of the switch element LD in the reset period. The switch SW 5 is turned off during a period in which the switch SW4 is turned on. As the result, the voltage applied between the drain and source of the switch element LD in the reset period can be decreased, therefore, it is possible to use an element whose rated voltage is low as the switch element LD.

Figure 23:
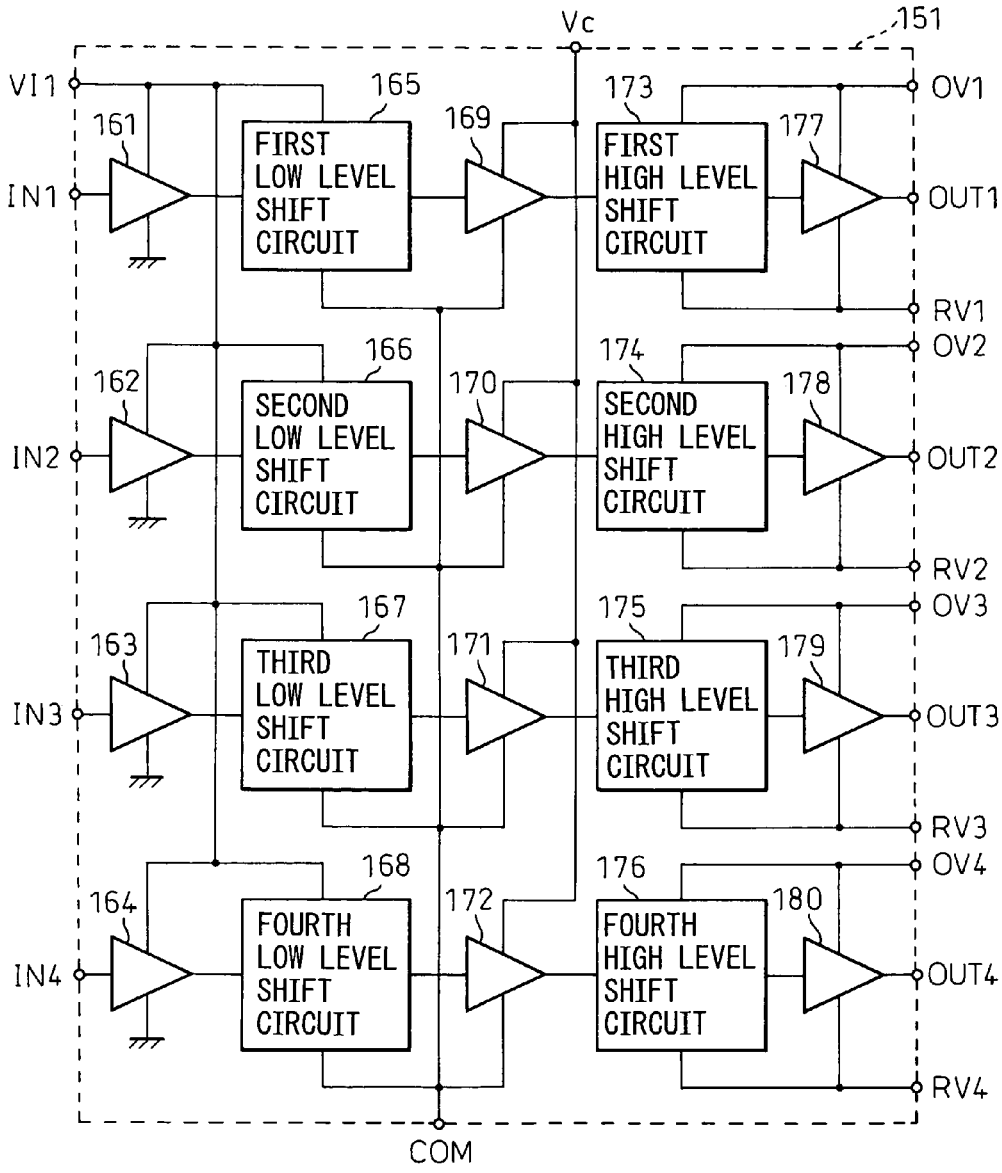
FIG. 23 is a diagram showing the constitution of a sustain circuit in a fifteenth embodiment of the present invention.

FIG. 23 is a diagram showing the constitution of a pre-drive circuit in a fifteenth embodiment of the present invention. The pre-drive circuit of the fifteenth embodiment differs from the pre-drive circuit of the tenth embodiment shown in FIG. 17 in that the pre-drive circuit of the fifteenth embodiment includes four inputs and four outputs although the pre-drive circuit of the tenth embodiment includes two inputs and two outputs. By this constitution, the differences between input and output delay times of the four drive systems can be reduced.

Figure 24:
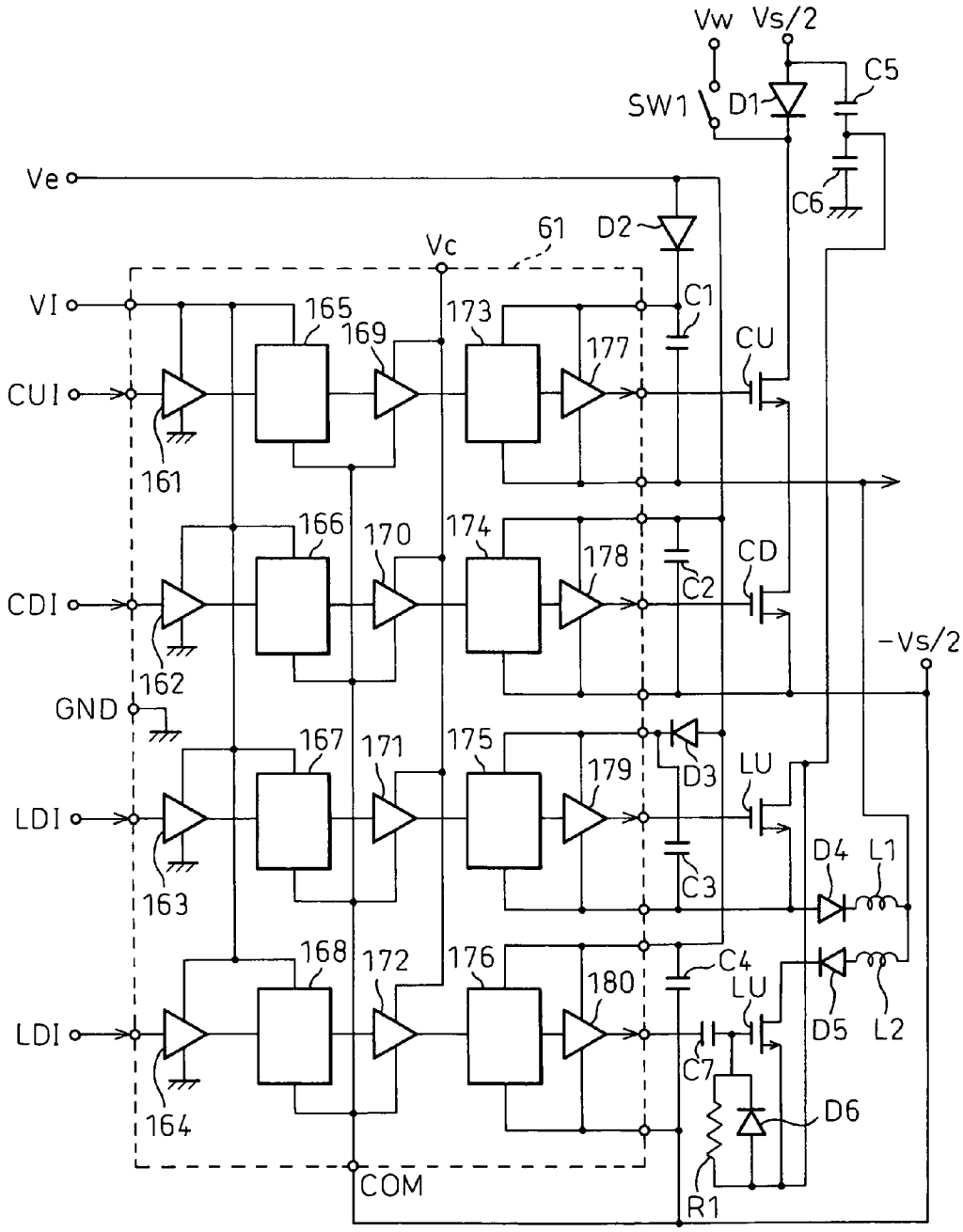
FIG. 24 is a diagram showing the constitution of a sustain circuit in a sixteenth embodiment of the present invention.

FIG. 24 is a diagram showing the constitution of a sustain circuit of a plasma display apparatus in a sixteenth embodiment of the present invention. The sustain circuit of the sixteenth embodiment is a circuit which has the sustain voltages of Vs/2 and −Vs/2 and is realized by using the drive circuit of the fifteenth embodiment. Since pulses supplied to gates of the elements CU, CD, LU and LD are generated by circuits constituted in the same IC, the differences between input and output delay times of the four drive systems can be reduced. Other constitutions are similar to those of the eleventh embodiment, therefore, more detailed descriptions are omitted. Further, the pre-drive circuit of the fifteenth embodiment can be similarly applied to the embodiments of the twelfth to fourteenth embodiments.

Figure 25:
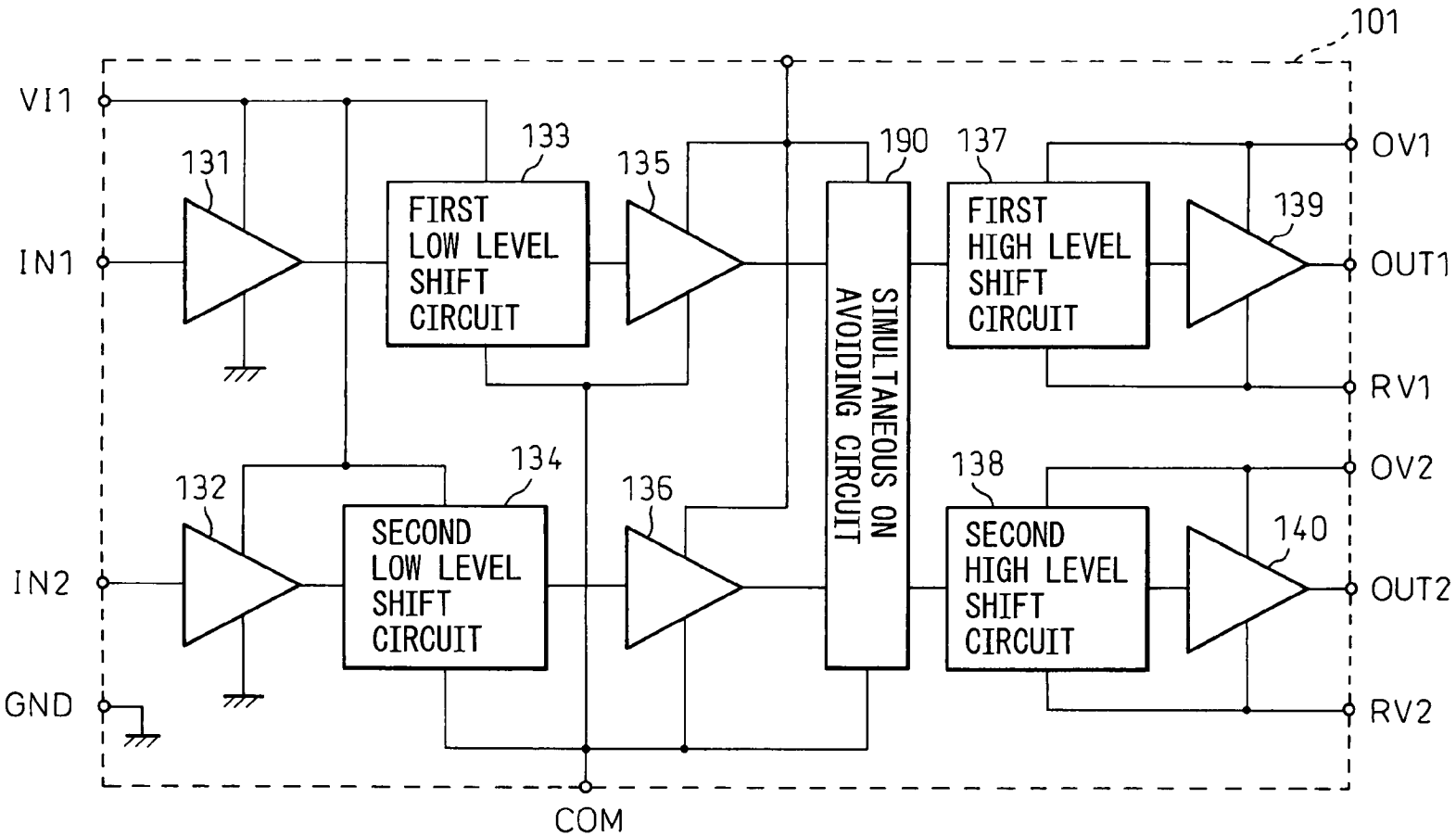
FIG. 25 is a diagram showing a specific constitution of the pre-drive circuit in the seventeenth embodiment.

FIG. 25 is a diagram showing the constitution of a pre-drive circuit in a seventeenth embodiment of the present invention. The pre-drive circuit of the seventeenth embodiment differs from the pre-drive circuit of the tenth embodiment shown in FIG. 17 in that a simultaneous ON avoiding circuit 190 is provided. The simultaneous ON avoiding circuit 190 is realized by a logic circuit. The simultaneous ON avoiding circuit 190 receives outputs of the first and second waveform processing circuits 135 and 136 and processes them so that the output voltages OUT1 and OUT2 do not simultaneously become active. The outputs of the simultaneous ON avoiding circuit 190 are input to the first and second high level shift circuits 137 and 138.

Figure 26:
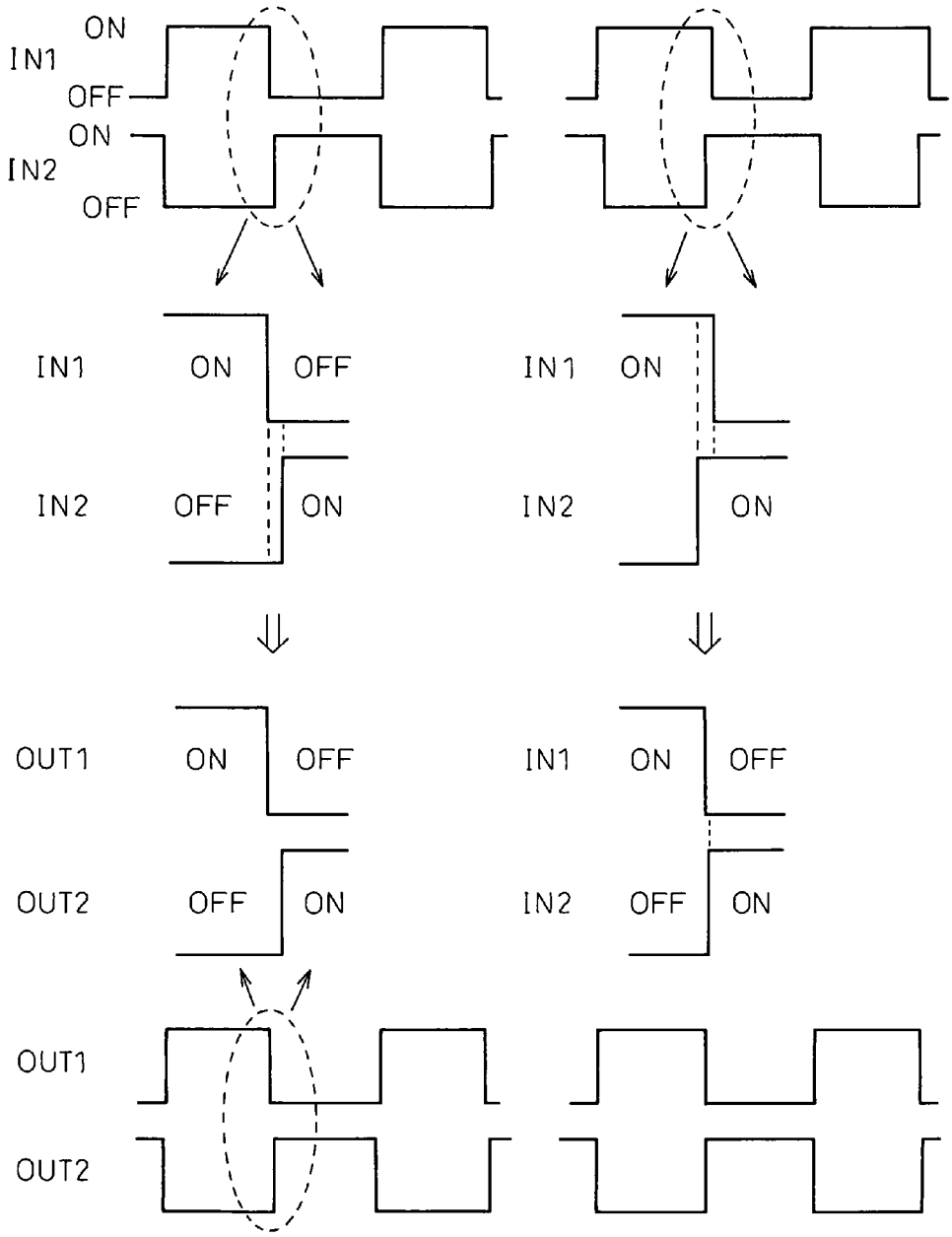
FIG. 26 is a diagram explaining an operation of a simultaneous on avoiding circuit of the pre-drive circuit in the seventeenth embodiment.

FIG. 26 is a diagram for explaining an operation of the simultaneous ON avoiding circuit 190. As shown in the left side of the figure, when the input voltage signal IN1 and IN2 do not become active simultaneously, namely, when one of them changes from an off-state to an on-state after the other changes from the on-state to the off-state, the simultaneous ON avoiding circuit 190 outputs the signals with no change. As shown in the right side of the figure, when the input voltage signal IN1 and IN2 become active simultaneously, namely, when one of them changes from the off-state to the on-state before the other changes from the on-state to the off-state, the simultaneous ON avoiding circuit 190 changes the signals so that the one changes from an off-state to an on-state after the other changes from the on-state to the off-state.

By providing the simultaneous ON avoiding circuit 190, a state in which the switch elements CU and CD or LU and LD are simultaneously turned on can be certainly avoided when the input voltage signals IN1 and IN2, which provide a condition that the elements CU and CD or LU and LD are simultaneously turned on, are input or when such condition occurs in the pre-drive circuit. According to this constitution, the increase in power consumption or destruction of the elements can be avoided and, therefore, the reliability of the circuit can be improved.

We claim:

1. A plasma display apparatus, comprising:

a plurality of X electrodes, a plurality of Y electrodes arranged adjacently to the plurality of X electrodes by turns and each causing a discharge to occur between the neighboring X and Y electrodes, an X electrode drive circuit for applying a discharge voltage to the plurality of X electrodes, and a Y electrode drive circuit for applying a discharge voltage to the plurality of Y electrodes;

a pre-drive circuit comprising first, second, third and fourth drive systems, each having an input amplifier circuit amplifying an input voltage, input to an input voltage terminal, a high level shift circuit shifting a level of a signal output from the input amplifier circuit and an output amplifier circuit amplifying a shift signal output from the high level shift circuit, wherein each drive system has a common constitution and the plurality of drive systems are provided within an IC formed on a common semiconductor chip;

at least one of the X electrode drive circuit and the Y electrode drive circuit comprising:

a first switch supplying a high level voltage to the plurality of X electrodes or the plurality of Y electrodes, a second switch supplying a low level voltage to the plurality of X electrodes or the plurality of Y electrodes, a third switch supplying a high level voltage to the plurality of X electrodes or the plurality of Y electrodes via a first coil, and a fourth switch supplying a low level voltage to the plurality of X electrodes or the plurality of Y electrodes via a second coil;

the first drive system of the pre-drive circuit driving the first switch;

the second drive system of the pre-drive circuit driving the second switch;

the third drive system of the pre-drive circuit driving the third switch; and the fourth drive system of the pre-drive circuit driving the fourth switch.

2. The plasma display apparatus as set forth in claim 1, wherein a voltage different from the reference voltage is applied to a terminal of the third switch, other than a terminal thereof connected to the plurality of X electrodes or the plurality of Y electrodes.

3. The plasma display apparatus as set forth in claim 1, wherein a voltage, other than a middle voltage between the high level voltage and the low level voltage, a supplied to a terminal of the third switch element other than a terminal thereof connected to the plurality of X electrodes or the plurality of Y electrodes.

* * * * *

UNITED STATES PATENT AND TRADEMARK OFFICE

CERTIFICATE OF CORRECTION

PATENT NO. : 7,084,839 B2
APPLICATION NO. : 10/776286
DATED : August 1, 2006
INVENTOR(S) : Makoto Onozawa et al.

It is certified that error appears in the above-identified patent and that said Letters Patent is hereby corrected as shown below:

Column 17, Line 3, after " voltage," change "a" to --is--.

Signed and Sealed this

Twenty-sixth Day of December, 2006

JON W. DUDAS
*Director of the United States Patent and Trademark Office*